US011557266B2

(12) United States Patent
Harwell

(10) Patent No.: US 11,557,266 B2
(45) Date of Patent: Jan. 17, 2023

(54) ADAPTIVE RECOLORING

(71) Applicant: Microsoft Technology Licensing, LLC, Redmond, WA (US)

(72) Inventor: Samuel Christopher Harwell, San Diego, CA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 17/340,815

(22) Filed: Jun. 7, 2021

(65) Prior Publication Data

US 2022/0392420 A1 Dec. 8, 2022

(51) Int. Cl.
*G09G 5/02* (2006.01)
*G09G 5/06* (2006.01)
(Continued)

(52) U.S. Cl.
CPC ..... *G09G 5/06* (2013.01); *G09G 2320/0606* (2013.01); *G09G 2320/0613* (2013.01);
(Continued)

(58) Field of Classification Search
CPC . G06T 11/001; G06T 7/11; G06T 7/13; G06T 11/203; G06T 2200/24; G06F 3/04845; G06F 3/04883; G06F 3/0484; G06F 3/04842; G09G 5/02; G09G 5/06; G09G 2320/0606; G09G 2320/066;
(Continued)

(56) References Cited

U.S. PATENT DOCUMENTS 10,509,553 B1 * 12/2019 Duan ..... G06T 11/203
11,106,343 B1 * 8/2021 Duan ..... G06F 3/04845
(Continued)

FOREIGN PATENT DOCUMENTS

WO 2016133702 A1 8/2016

OTHER PUBLICATIONS

"IntelliJ IDEA vs JetBrains Rider", retrieved from <<https://www.stackshare.io/stackups/intellij-idea-vs-jetbrains-rider>>, 13 pages, May 12, 2021.
(Continued)

*Primary Examiner* — Wesner Sajous
(74) *Attorney, Agent, or Firm* — Ogilvie Law Firm

(57) ABSTRACT

Adaptive recoloring of displayed digital content automatically pursues specified active color palette goals while adhering to specified active color palette constraints. Source code editors, word processors, and other programs are enhanced by adaptive recoloring. Recoloring rules may specify coloring roles, colors, tolerances, color spaces, metrics, and other criteria. Recoloring may be triggered by a zoom or another change in user focus, by a brightness change, a screen size change, by notice of a user perception change, or by another event. Recoloring improves text legibility, assists user focus, compensates for differences in color perception and emotional impact, and increases color availability without degrading usability, for example. Transitions between words or other display items can be heightened. Branding colors may be preserved, in logos and text. Automatic selections may be overridden by a user command or by interactive tuning, with warnings given as appropriate.

20 Claims, 4 Drawing Sheets

(51) Int. Cl.

| | |
|---|---|
| ***G06T 11/00*** | (2006.01) |
| ***G06T 7/11*** | (2017.01) |
| ***G06T 11/20*** | (2006.01) |
| ***G06T 7/13*** | (2017.01) |
| ***H04N 1/60*** | (2006.01) |
| ***H04N 9/43*** | (2006.01) |
| ***G06F 3/048*** | (2013.01) |

(52) U.S. Cl.
CPC ..... *G09G 2320/0666* (2013.01); *G09G 2320/0686* (2013.01); *G09G 2340/045* (2013.01); *G09G 2340/06* (2013.01); *G09G 2354/00* (2013.01); *G09G 2360/144* (2013.01); *G09G 2360/145* (2013.01)

(58) Field of Classification Search
CPC ... G09G 2320/0613; G09G 2320/0666; G09G 2320/0686; G09G 2340/06; G09G 2340/045; G09G 2354/00; G09G 2360/144; G09G 2360/145; H04N 1/6038; H04N 1/60; H04N 1/6019; H04N 1/6027; H04N 1/6041; H04N 1/6077; H04N 9/43; H04N 9/64; H04N 9/69; H04N 9/73
See application file for complete search history.

(56) References Cited

U.S. PATENT DOCUMENTS

| | | | | |
|---|---|---|---|---|
| 2019/0355155 | A1* | 11/2019 | Shugrina | G06T 11/001 |
| 2019/0378249 | A1* | 12/2019 | Rathore | G06T 7/90 |
| 2021/0042965 | A1* | 2/2021 | Phogat | G06V 10/763 |
| 2021/0272331 | A1* | 9/2021 | Phogat | G06T 7/90 |
| 2022/0019343 | A1* | 1/2022 | Duan | G06T 7/12 |

OTHER PUBLICATIONS

"ReSharper: The Visual Studio Extension for .NET Developers", retrieved from <<https://www.jetbrains.com/resharper/>>, 8 pages, no later than May 24, 2021.
"Contrast ratio", retrieved from <<https://en.wikipedia.org/wiki/Contrast_ratio>>, 3 pages, May 10, 2021.
Anupama Jamwal et al., "Color Compensation for Vision Defects", retrieved from <<https://ijarcce.com/wp-content/uploads/2016/09/IJARCCE-77.pdf›, Sep. 2016, 3 pages.
Zhenyang Zhu et al., "Processing images for red-green dichromats compensation via naturalness and information-preservation considered recoloring", retrieved from <<https://link.springer.com/content/pdf/10.1007/s00371-019-01689-4.pdf>>, May 7, 2019, 14 pages.
"Color difference", retrieved from <<https://en.wikipedia.org/wiki/Color_difference>>, May 11, 2021, 10 pages.
"HSL and HSV", retrieved from <<https://en.wikipedia.org/wiki/HSL_and_HSV>>, May 1, 2021, 20 pages.
"Impossible color", retrieved from <<https://en.wikipedia.org/wiki/Impossible_color>>, May 11, 2021, 7 pages.
"Image compression", retrieved from <<https://en.wikipedia.org/wiki/Image_compression>>, May 7, 2021, 5 pages.
"JPEG", retrieved from <<https://en.wikipedia.org/wiki/JPEG>>, May 8, 2021, 34 pages.
Phillip Swann, "Should You Set Your TV to Vivid or Cinema?", retrieved from <<https://tvanswerman.com/2018/03/21/should-you-set-your-tv-to-vivid-or-cinema/>>, Mar. 21, 2018, 10 pages.
"Web accessibility", retrieved from <<https://en.wikipedia.org/wiki/Web_accessibility>>, Apr. 22, 2021, 16 pages.
"Color blindness", retrieved from <<https://en.wikipedia.org/wiki/Color_blindness>>, May 7, 2021, 26 pages.
"Syntax highlighting", retrieved from <<https://en.wikipedia.org/wiki/Syntax_highlighting>>, Apr. 15, 2021, 5 pages.
"Steganography", retrieved from <<https://en.wikipedia.org/wiki/Steganography>>, Apr. 30, 2021, 16 pages.
"Irlen syndrome", retrieved from <<https://en.wikipedia.org/wiki/Irlen_syndrome>>, May 7, 2021, 6 pages.
"Cataract", retrieved from <<https://en.wikipedia.org/wiki/Cataract>>, May 15, 2021, 19 pages.
"Color space", retrieved from <<https://en.wikipedia.org/wiki/Color_space>>, Mar. 21, 2021, 8 pages.
"Hill climbing", retrieved from <<https://en.wikipedia.org/wiki/Hill_climbing>>, May 3, 2021, 5 pages.
"Mathematical optimization", retrieved from <<https://en.wikipedia.org/wiki/Mathematical_optimization>, May 7, 2021, 16 pages.
"Optical illusion", retrieved from <<https://en.wikipedia.org/wiki/Optical_illusion>>, May 5, 2021, 16 pages.
"Chromatic adaptation", retrieved from <<https://en.wikipedia.org/wiki/Chromatic_adaptation>>, May 8, 2021, 3 pages.
"Color constancy", retrieved from <<https://en.wikipedia.org/wiki/Color_constancy>>, May 12, 2021, 8 pages.
"Acutance", retrieved from <<https://en.wikipedia.org/wiki/Acutance>>, Sep. 11, 2020, 3 pages.
"Edge enhancement", retrieved from <<https://en.wikipedia.org/wiki/Edge_enhancement>>, Nov. 23, 2020, 3 pages.
"Color gradient", retrieved from <<https://en.wikipedia.org/wiki/Color_gradient>>, Apr. 25, 2021, 6 pages.
"Expert font-weight control", retrieved from <<http://www.asmarterwaytolearn.com/pro-html-css/expert-font-weight-control.html>>, no later than May 24, 2021, 7 pages.
"Designing for Web Accessibility", retrieved from <<https://www.w3.org/WAI/tips/designing/>>, Jan. 9, 2019, 13 pages.
"Paint Color Choices for Children on the Autism Spectrum", retrieved from <<https://www.ppgpaints.com/paint-colors-for-autism>>, no later than May 24, 2021, 7 pages.
Elaine C. Zachi, "Color Vision Losses in Autism Spectrum Disorders", retrieved from <<https://www.ncbi.nlm.nih.gov/pmc/articles/PMC5492848/>>, Jun. 30, 2017, 20 pages.
Matt Ellis, "Branding colors: everything you need to choose your brand's color palette", retrieved from <<https://99designs.com/blog/tips/branding-colors/>>, 2017, 23 pages.
"PredefinedAdornmentLayers Class", retrieved from <<https://docs.microsoft.com/en-us/dotnet/api/microsoft.visualstudio.text.editor.predefinedadornmentlayers?view=visualstudiosdk-2019>>, 2019, 2 pages.
Lihao Xu, "Color gamut mapping between small and large color gamuts: part II. gamut extension", retrieved from<<https://doi.org/10.1364/OE.26.017335>>, 2018, 18 pages.
Nick Babich, "22 Basic UX Laws That Every Designer Should Know", retrieved from <<https://www.shopify.com/partners/blog/ux-laws>>, Aug. 19, 2019, 26 pages.
Satoshi Oshima et al., "Color-Weakness Compensation using Riemann Normal Coordinates", retrieved from <<https://www.diva-portal.org/smash/get/diva2:579544/FULLTEXT05>>, 2012, 5 pages.
Rachel Cravit, "How to Use Color Blind Friendly Palettes to Make Your Charts Accessible", retrieved from <<https://venngage.com/blog/color-blind-friendly-palette/>>, Aug. 21, 2019, 32 pages.
"The Use of Color in Behavioral Disorders", retrieved from <<http://renketkisi.com/en/the-use-of-color-in-behavioral-disorders.html>>, 2017, 6 pages.
Beth Rutledge, "Color for Special Needs", retrieved from <<https://www.sherwin-williams.com/architects-specifiers-designers/education/project-profiles/sw-art-stir-colors-matter>>, no later than May 21, 2021, 2 pages.
"Cognitive", retrieved from <<https://webaim.org/articles/cognitive/>>, Aug. 21, 2020, 4 pages.
"Invitation To Pay Additional Fees issued in PCT Application No. PCT/US22/028421", dated Aug. 26, 2022, 18 Pages.
"International Search Report & Written Opinion issued in PCT Application No. PCT/US22/028421", dated Oct. 17, 2022, 22 Pages.

* cited by examiner

ADAPTIVE RECOLORING

BACKGROUND

Programs for creating, modifying, or otherwise editing documents were among the first software tools created, and such editors have undergone many changes over time, including many improvements. Some editing tools accept input not only in the form of characters typed on a keyboard, but also in the form of data sent from a mouse, pen, touch pad, touch screen, microphone, or other device. Many editors provide a WYSIWYG (what you see is what you get) user experience, so that an appearance of a document onscreen in the editor closely resembles a result of printing the document. Some editors support integration of graphic images into a document, or provide a user with access to graphics editing tools within a document editing session.

The range of "text" operated upon by an editor was originally limited mostly to alphabet letters, numbers, and punctuation. But over time, the text one can edit with a program has expanded to include at least mathematical symbols, geometric shapes, music and other notational systems, logographic and syllabic scripts, and many other written symbols. As of the present time, the Unicode® technology standard for encoding, representing, and handling text covers over 150 modern and historic scripts, including over 140,000 characters (mark of Unicode, Inc.).

Some editors are specialized for particular knowledge areas or fields of practice, such as video editing, still image editing, sound editing, or software source code editing. In particular, some source code editors provide integrated functionality for syntax checking, autocompletion, indentation, brace matching, and easy access to a compiler, interpreter, or debugger.

Despite these advancements, improvements are still possible in the field of tools for editing source code or other documents that contain text or other visual content.

SUMMARY

Some embodiments described herein adaptively recolor displayed digital content to pursue specified goals while adhering to specified constraints. Recoloring may be done automatically to improve legibility, assist user focus, compensate for differences in the perception and impact of colors, or increase color availability without degrading usability, for example. Branding colors may nonetheless be preserved, and automatic selections may be overridden.

Some embodiments described herein use or provide a hardware and software combination which is configured to perform adaptive recoloring. The combination includes a digital memory, and a processor which is in operable communication with the memory. The processor is configured, e.g., by adaptive recoloring software, to perform steps which include identifying one or more active color palette constraints, ascertaining one or more active color palette goals, determining an optimized color palette which is closer to at least one active color palette goal than a preliminary color palette and which is compliant with all active color palette constraints, and configuring at least a portion of a display to use the optimized color palette in place of the preliminary color palette. Related method and storage device embodiments are also disclosed herein.

Other technical activities and characteristics pertinent to teachings herein will also become apparent to those of skill in the art. The examples given are merely illustrative. This Summary is not intended to identify key features or essential features of the claimed subject matter, nor is it intended to be used to limit the scope of the claimed subject matter. Rather, this Summary is provided to introduce—in a simplified form—some technical concepts that are further described below in the Detailed Description. The innovation is defined with claims as properly understood, and to the extent this Summary conflicts with the claims, the claims should prevail.

DESCRIPTION OF THE DRAWINGS

A more particular description will be given with reference to the attached drawings. These drawings only illustrate selected aspects and thus do not fully determine coverage or scope.

DETAILED DESCRIPTION

Overview

Innovations may expand beyond their origins, but understanding an innovation's origins can help one more fully appreciate the innovation. In the present case, some teachings described herein were motivated by the experiences of a Microsoft innovator who recognized and faced technical challenges arising from an effort to expand color usage in a source code editor of a Visual Studio® integrated development environment without degrading the editor's ease of use (mark of Microsoft Corporation).

Overtime, various developers had made various color assignments in Visual Studio® deployments to identify or emphasize particular source code editor features or programming language features. These included some color assignments that were very familiar to the innovator from frequent use of the Visual Studio® editor, and some color assignments that were made by the innovatorfor personal use.

A proposed color assignment unfortunately clashed with one of these familiar color assignments, in that the proposed color looked very similar to a color that was already assigned to a different feature. Simply adding the proposed color assignment to the innovator's Visual Studio® deployment would likely cause confusion, or at the very least would decrease the editor's ease of use because effort would be needed to decide which feature was being indicated each time one of the two similar colors was displayed.

Thus, the innovator faced the technical challenge of how to avoid the clash of these similar colors without losing the functionality provided by having features be identified visually by respective colors. One theoretical approach would be to reassign most or all features respective colors from scratch, with none of the reassigned colors being close enough to be confused with one another. This was not considered a good solution, because it would have required learning the new color assignments from scratch. Accordingly, a subordinate technical challenge was how to avoid the color clash without losing the benefits of familiarity with the existing association between colors and the features they represented.

After some thought and experimentation, the innovator was able to modify several color assignments in the innovator's personal editor just enough to make room for the proposed color. The modified colors were different enough from the proposed color to be visually distinguished from it, while still being close enough to their pre-modification counterparts to be recognizable as representing the same respective features. The experimentation was partially automated by a prototype recoloring program the innovator wrote to measure color differences using a CIEDE2000 color metric for colors in the foreground role, and contrast ratio for comparing foreground role with background role. These experiences led the innovator to think about different ways to automate recoloring, which eventually led to the present disclosure.

Operating Environments

Figure 1:
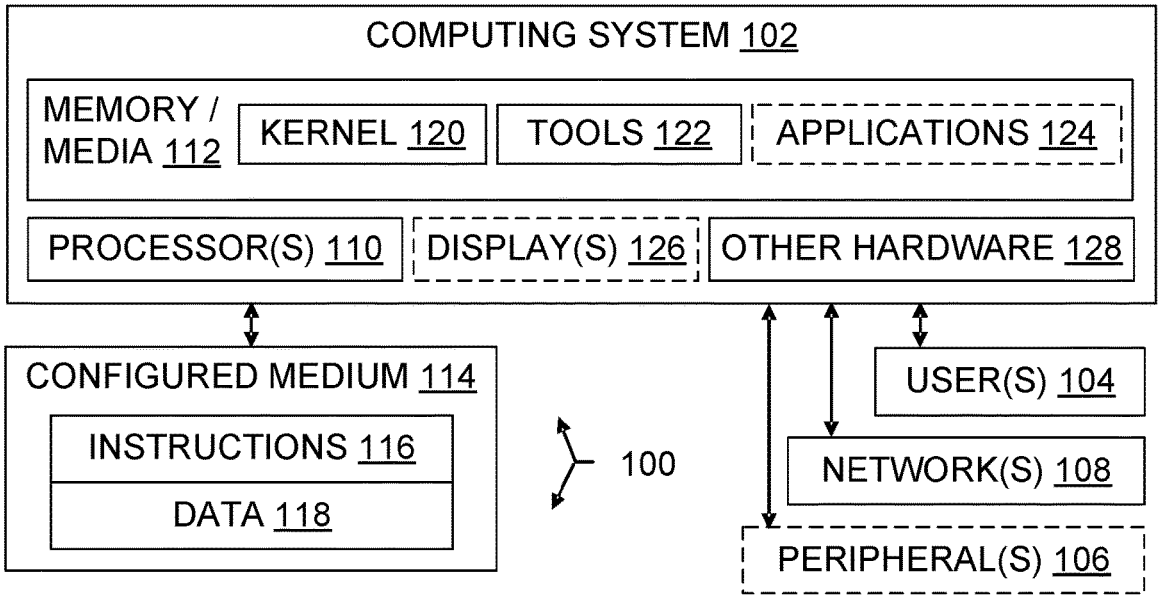
FIG. 1 is a block diagram illustrating computer systems generally and also illustrating configured storage media generally.

With reference to FIG. 1, an operating environment 100 for an embodiment includes at least one computer system 102. The computer system 102 may be a multiprocessor computer system, or not. An operating environment may include one or more machines in a given computer system, which may be clustered, client-server networked, and/or peer-to-peer networked within a cloud. An individual machine is a computer system, and a network or other group of cooperating machines is also a computer system. A given computer system 102 may be configured for end-users, e.g., with applications, for administrators, as a server, as a distributed processing node, and/or in other ways.

Human users 104 may interact with the computer system 102 by using displays, keyboards, and other peripherals 106, via typed text, touch, voice, movement, computer vision, gestures, and/or other forms of I/O. A screen or other display 126 may be a removable peripheral 106 or may be an integral part of the system 102. A user interface may support interaction between an embodiment and one or more human users. A user interface may include a command line interface, a graphical user interface (GUI), natural user interface (NUI), voice command interface, and/or other user interface (UI) presentations, which may be presented as distinct options or may be integrated.

System administrators, network administrators, cloud administrators, security analysts and other security personnel, operations personnel, developers, testers, engineers, auditors, and end-users are each a particular type of user 104. Automated agents, scripts, playback software, devices, and the like acting on behalf of one or more people may also be users 104, e.g., to facilitate testing a system 102. Storage devices and/or networking devices may be considered peripheral equipment in some embodiments and part of a system 102 in other embodiments, depending on their detachability from the processor 110. Other computer systems not shown in FIG. 1 may interact in technological ways with the computer system 102 or with another system embodiment using one or more connections to a network 108 via network interface equipment, for example.

Each computer system 102 includes at least one processor 110. The computer system 102, like other suitable systems, also includes one or more computer-readable storage media 112. Storage media 112 may be of different physical types. The storage media 112 may be volatile memory, nonvolatile memory, fixed in place media, removable media, magnetic media, optical media, solid-state media, and/or of other types of physical durable storage media (as opposed to merely a propagated signal or mere energy). In particular, a configured storage medium 114 such as a portable (i.e., external) hard drive, CD, DVD, memory stick, or other removable nonvolatile memory medium may become functionally a technological part of the computer system when inserted or otherwise installed, making its content accessible for interaction with and use by processor 110. The removable configured storage medium 114 is an example of a computer-readable storage medium 112. Some other examples of computer-readable storage media 112 include built-in RAM, ROM, hard disks, and other memory storage devices which are not readily removable by users 104. For compliance with current United States patent requirements, neither a computer-readable medium nor a computer-readable storage medium nor a computer-readable memory is a signal per se or mere energy under any claim pending or granted in the United States. Any claim interpretation to the contrary is not reasonable.

The storage medium 114 is configured with binary instructions 116 that are executable by a processor 110; "executable" is used in a broad sense herein to include machine code, interpretable code, bytecode, and/or code that runs on a virtual machine, for example. The storage medium 114 is also configured with data 118 which is created, modified, referenced, and/or otherwise used for technical effect by execution of the instructions 116. The instructions 116 and the data 118 configure the memory or other storage medium 114 in which they reside; when that memory or other computer readable storage medium is a functional part of a given computer system, the instructions 116 and data 118 also configure that computer system. In some embodiments, a portion of the data 118 is representative of real-world items such as product characteristics, inventories, physical measurements, settings, images, readings, targets, volumes, and so forth. Such data is also transformed by backup, restore, commits, aborts, reformatting, and/or other technical operations.

Although an embodiment may be described as being implemented as software instructions executed by one or more processors in a computing device (e.g., general purpose computer, server, or cluster), such description is not meant to exhaust all possible embodiments. One of skill will understand that the same or similar functionality can also often be implemented, in whole or in part, directly in hardware logic, to provide the same or similar technical effects. Alternatively, or in addition to software implementation, the technical functionality described herein can be performed, at least in part, by one or more hardware logic components. For example, and without excluding other implementations, an embodiment may include hardware logic components 110, 128 such as Field-Programmable Gate Arrays (FPGAs), Application-Specific Integrated Circuits (ASICs), Application-Specific Standard Products (ASSPs), System-on-a-Chip components (SOCs), Complex Programmable Logic Devices (CPLDs), and similar components. Components of an embodiment may be grouped into interacting functional modules based on their inputs, outputs, and/or their technical effects, for example.

In addition to processors 110 (e.g., CPUs, ALUs, FPUs, TPUs and/or GPUs), memory/storage media 112, and displays 126, an operating environment may also include other hardware 128, such as batteries, buses, power supplies, wired and wireless network interface cards, for instance. A display 126 may include one or more touch screens, screens responsive to input from a pen or tablet, or screens which operate solely for output. In some embodiments, peripherals 106 such as human user I/O devices (screen, keyboard, mouse, tablet, microphone, speaker, motion sensor, etc.) will be present in operable communication with one or more processors 110 and memory.

In some embodiments, the system includes multiple computers connected by a wired and/or wireless network 108. Networking interface equipment 128 can provide access to networks 108, using network components such as a packet-switched network interface card, a wireless transceiver, or a telephone network interface, for example, which may be present in a given computer system. Virtualizations of networking interface equipment and other network components such as switches or routers or firewalls may also be present, e.g., in a software-defined network or a sandboxed or other secure cloud computing environment. In some embodiments, one or more computers are partially or fully "air gapped" by reason of being disconnected or only intermittently connected to another networked device or remote cloud. In particular, adaptive recoloring functionality could be installed on an air gapped network and then be updated periodically or on occasion using removable media. A given embodiment may also communicate technical data and/or technical instructions through direct memory access, removable nonvolatile storage media, or other information storage-retrieval and/or transmission approaches.

One of skill will appreciate that the foregoing aspects and other aspects presented herein under "Operating Environments" may form part of a given embodiment. This document's headings are not intended to provide a strict classification of features into embodiment and non-embodiment feature sets.

One or more items are shown in outline form in the Figures, or listed inside parentheses, to emphasize that they are not necessarily part of the illustrated operating environment or all embodiments, but may interoperate with items in the operating environment or some embodiments as discussed herein. It does not follow that items not in outline or parenthetical form are necessarily required, in any Figure or any embodiment. In particular, FIG. 1 is provided for convenience, inclusion of an item in FIG. 1 does not imply that the item, or the described use of the item, was known prior to the current innovations.

More About Systems

As a preliminary matter, one may observe that because this disclosure discusses colors, some examples of display images in color could be helpful. However, utility patent documents are generally limited to black and white, or to black and white with shades of grey. Therefore, to reach the broadest audience in multiple jurisdictions, examples of images 600 that are given herein are described by text or by line drawings or both, instead of by color images.

Figure 2:
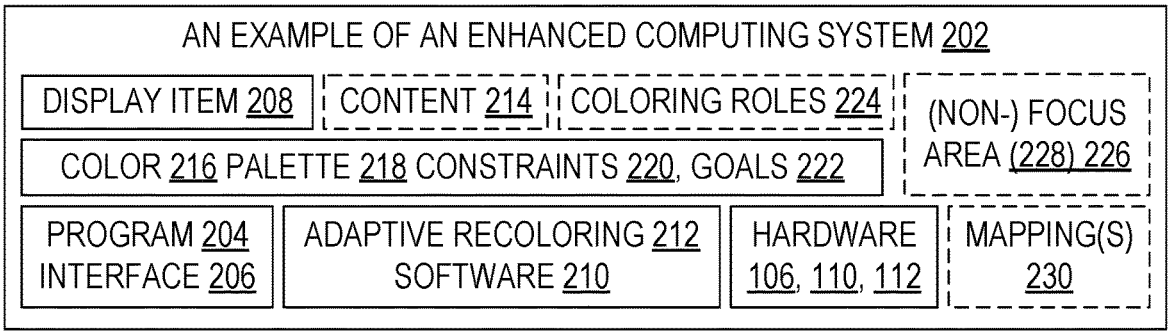
FIG. 2 is a block diagram illustrating aspects of a computing system which has one or more of the adaptive recoloring enhancements taught herein.

FIG. 2 illustrates a computing system 102 configured by one or more of the adaptive recoloring enhancements taught herein, resulting in an enhanced system 202. This enhanced system 202 may include a single machine, a local network of machines, machines in a particular building, machines used by a particular entity, machines in a particular datacenter, machines in a particular cloud, or another computing environment 100 that is suitably enhanced. The illustrated system 202 includes hardware such as a processor 110, memory 112, and display 126, as well as one or more I/O device peripherals 106 such as a keyboard, mouse, microphone, or speakers.

The illustrated system 202 includes a program 204 having a user interface 206 capable of visually displaying items 208. The program 204 may be an application 124, a tool 122 designed for software development or another purpose, or an operating system or other kernel 120, for example. The program 204 includes or utilizes special-purpose software 210 for adaptive recoloring 212 as taught herein.

Editors such as general-purpose text editors and source code editors are some examples of programs 204. A document 602 containing natural language text 604 or source code text 606 or other visually displayable content 214 may be brought from a file, blob, etc. of a disk, server, storage resource, or other machine, etc. into the editor 204 for editing. Editing occurs in response to input received through the user interface 206. The document content 214 may be displayed on the display device 126 by operation of the user interface 206. The content is displayed in two or more colors 216 of a color palette 218.

Text content 214 includes, but is not limited to, alphanumeric characters. Symbols, kanji, widgets, icons, emojis, and all other non-alphanumeric characters are considered to be text if they belong to a font, e.g., a Unicode® font (mark of Unicode, Inc.). Any character or other glyph that belongs to a Unicode® font is text content 214. In addition to text content, or instead of text content, documents 602 may contain content 214 that is not text. The particular fonts, font sizes, colors, natural language texts, and programming language texts used may vary in an embodiment or vary across embodiments. The text 214 may be read from a file, may be entered by typing or by pasting, may be entered through suggestion acceptance and commitment, or (perhaps most likely) may be created through a combination of these and other operations.

Some examples of non-text content 214 include line drawings, photographs, and user interface parts such as sliders, cursors, window borders, and non-Unicode® icons.

The illustrated system 202, and in particular the editor program 204, is enhanced by the presence and operation of innovative functionality that performs adaptive recoloring as taught herein. In this example, adaptive recoloring 212 includes displaying colors 216 in a manner consistent with certain color palette constraints 220 and in pursuit of certain color palette goals 222. Although they are referred to as color palette constraints and goals, the constraints 220 and goals 222 may also be considered adaptive recoloring constraints 220 and adaptive recoloring goals 222 that also involve one or more color palettes 218.

In this example, the constraints 220 or goals 222 are defined in terms of one or more colors 216, and they may involve coloring roles 224 such as foreground, background, highlighting, and so on. The constraints 220 or goals 222 may also or instead involve a focus area 226 of the display 126 where the user's attention is (or should be) focused, or a non-focus area 228, or both. The constraints 220 or goals 222 may be met or pursued using a mapping 230, such as a perception compensation mapping 230 that is designed to enhance text legibility for users 104 who see fewer color red differences, for instance, than some other users, or users who have difficulty distinguishing between red and green.

Figure 3:
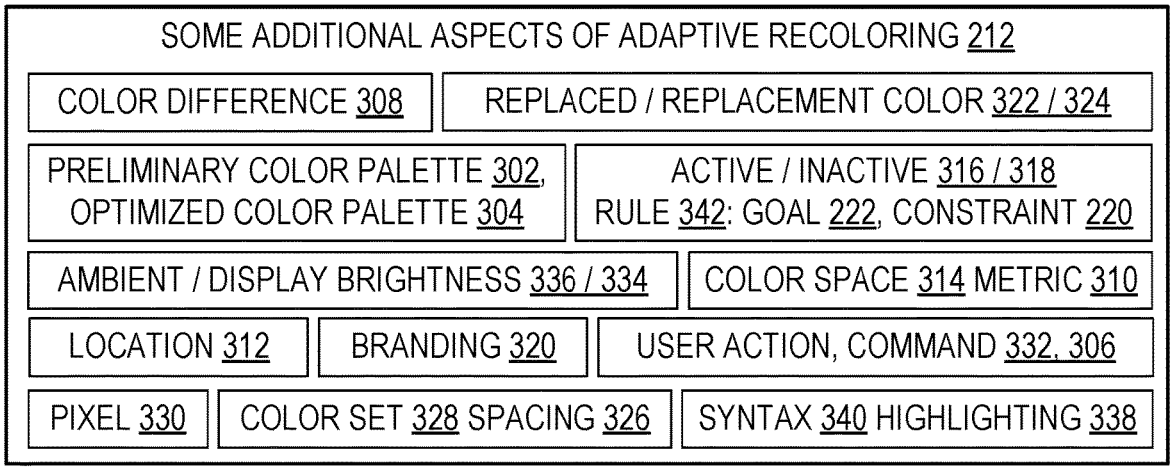
FIG. 3 is a block diagram illustrating some additional aspects of adaptive recoloring.

FIG. 3 shows some additional aspects of adaptive recoloring in some embodiments. This is not a comprehensive summary of all adaptive recoloring 212 aspects, or of every potential constituent of a constraint 220 definition or a goal 222 definition. These FIG. 3 items are discussed at various points herein, and additional details regarding them are provided in the discussion of a List of Reference Numerals later in this disclosure document.

Figure 4:
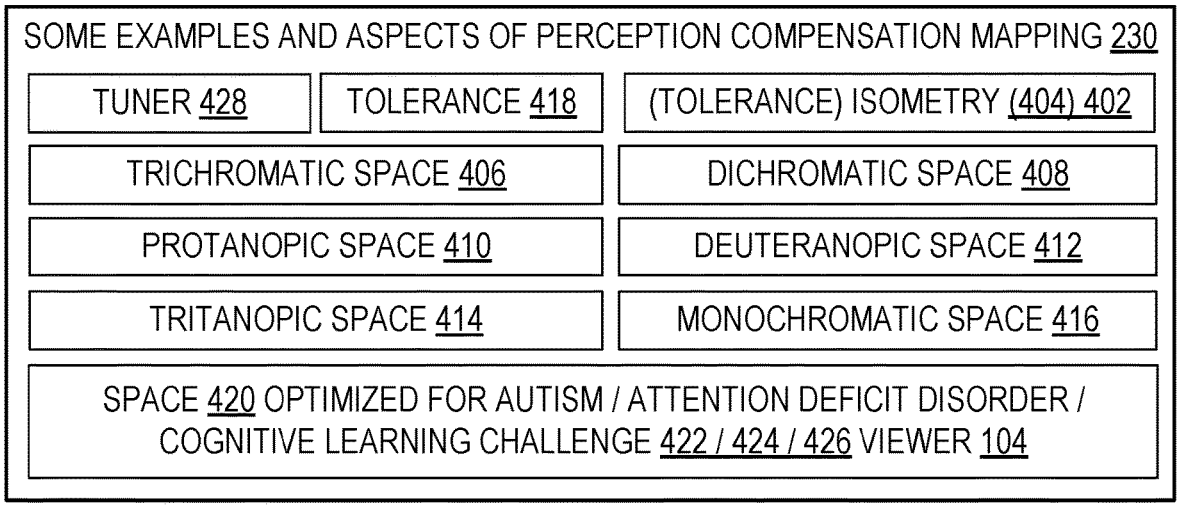
FIG. 4 is a block diagram illustrating some examples and aspects of perception compensation mapping for adaptive recoloring.

FIG. 4 shows some examples and aspects of perception compensation mapping 230 in some embodiments. This is not a comprehensive summary of all adaptive recoloring mapping 230 aspects, or of every potential mapping 230 involved in a constraint 220 or goal 222. These FIG. 4 items are discussed at various points herein, and additional details regarding them are provided in the discussion of a List of Reference Numerals later in this disclosure document.

Figure 5:
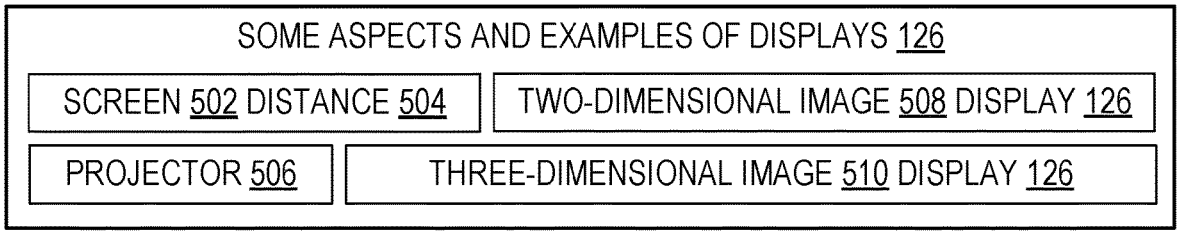
FIG. 5 is a block diagram illustrating some examples of display devices.

FIG. 5 shows some examples of displays 126 in some embodiments. This is not a comprehensive summary of all the displays 126 that are suitable for adaptive recoloring usage. These FIG. 5 items are discussed at various points herein, and additional details regarding them are provided in the discussion of a List of Reference Numerals later in this disclosure document.

Figure 6:
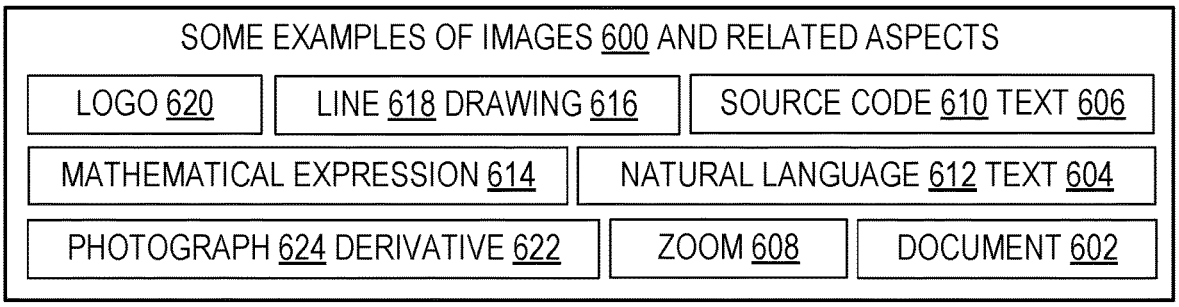
FIG. 6 is a block diagram illustrating some examples of images and related aspects.

FIG. 6 shows some examples of images 600 in some embodiments. This is not a comprehensive summary of all displayable images 600 that are subject to, or a result of, adaptive recoloring. These FIG. 6 items are discussed at various points herein, and additional details regarding them are provided in the discussion of a List of Reference Numerals later in this disclosure document.

Figure 7:
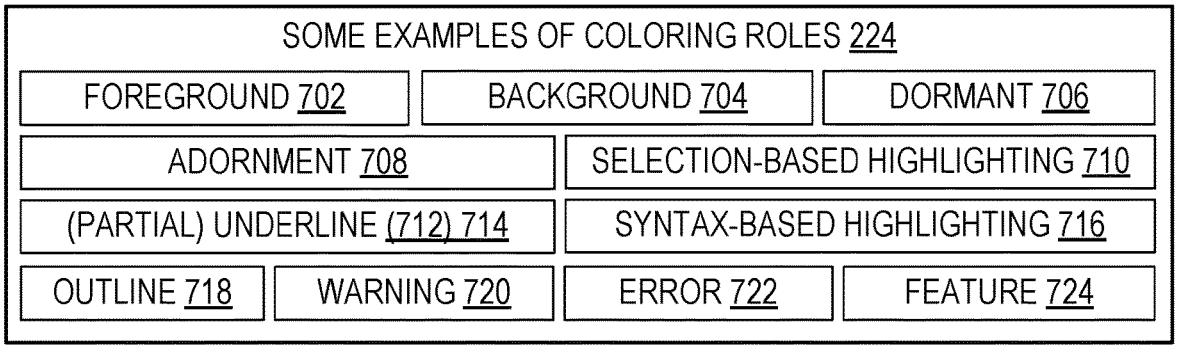
FIG. 7 is a block diagram illustrating some examples of coloring roles.

FIG. 7 shows some examples of coloring roles 224 in some embodiments. This is not a comprehensive summary of all coloring roles 224 that may be utilized during adaptive recoloring. These FIG. 7 items are discussed at various points herein, and additional details regarding them are provided in the discussion of a List of Reference Numerals later in this disclosure document.

Some embodiments use or provide a functionality-enhanced system, such as system 202 or another system 102 that is enhanced as taught herein. In some embodiments, an enhanced system is equipped for adaptive recoloring 212. This enhanced system includes a digital memory 112, a processor 110 in operable communication with the memory, and a display device 126 having an associated preliminary color palette 302. The preliminary color palette 302, or any other color palette 218 discussed herein, may also or instead be considered to be associated with the configured processor 110 or the memory 112, or both. The digital memory is configurable to contain content 214 including portions for display as display items 208. The digital memory 112 may be volatile or nonvolatile or a mix.

The processor 110 is configured to perform adaptive recoloring steps. The steps include automatically (a) identifying 802 one or more active color palette constraints 220, (b) ascertaining 804 one or more active color palette goals 222, (c) determining 806 an optimized color palette 304 which is closer to at least one active color palette goal 222 than the preliminary color palette 302 and which is compliant 808 with all active color palette constraints 220, and (d) configuring 812 at least a portion of the display 126 to use 814 the optimized color palette 304 in place of the preliminary color palette 302. Constraints 220 and goals 222 are "active" in the sense that they will be complied with and pursued unless they are deactivated, e.g., by a user override 306, or deleted.

Some embodiments define constraints 220 or goals 222 or both in terms of coloring roles 224. FIG. 7 shows some examples of coloring roles 224, including foreground 702, background 704, dormant 706 (sometimes shown in grey or referred to as "grey text"), adornment 708 (e.g. squiggles), selection-based highlighting 710, partial underline 712, underline 714, syntax-based highlighting 716, outline 718, warning 720, error 722, and colors assigned to different language or tool features 724 in a source code editor or other software development tool. For example, warnings may be displayed in a different color than other text, and text which represents different syntactic units in source code may be displayed in different respective colors.

Color 216, coloring role 224, color difference 308, and display item 208 are distinct but related items. As an example, assume the word "GREEN" is displayed in green letters on a white background, and the word "RED" is displayed in red letters on a white background. Then the word "GREEN" is a first display item 208 which has green 216 in the foreground role 702 and white 216 in the background role 704, whereas the word "RED" is a second display item 208 which has red 216 in the foreground role 702 and white 216 in the background role 704. A difference 308 between the foreground green color 216 in the first display item and the foreground red color 216 in the second display item can be measured using various color space metrics 310.

In some embodiments, a display item 208 may be a character, word, clause, sentence, paragraph, or other portion of a displayed text. The extent of the portion varies according to the embodiment involved, and may also vary according to how a particular embodiment is configured, e.g., a default portion may be a word, and may be expanded to a paragraph by an additional gesture 332.

Given a set of constraints 220 and goals 222, various optimizations 212 can be defined in terms of color roles 224, with the understanding that a difference between two roles X and Y involves a difference 308 between a color 216 in role X and a color 216 in role Y. Thus, the difference 308 between foreground 702 and background 704 in the first display item is currently the difference 308 between green and white. Similarly, a difference between two display locations M and N 312 that have the same role 224 involves a difference 308 between the color 216 in that role at location M and the color 216 in that role at location N. Thus, the difference 308 between the first display item foreground 702 and the second display item foreground 702 is currently the difference 308 between green and red.

Notice that a difference 308 between two locations 312 could be held constant even though different colors 216 are being shown 814 at one or both of those locations over time. Likewise, a difference 308 between two roles 224 could be held constant even though different colors 216 are being used 814 in one or both of those roles over time.

A difference 308 between two display items 208 refers to any difference between colors 216 used in corresponding roles 224 in the two items, e.g., a difference 308 between the two items' respective foreground colors or a difference 308 between the two items' respective background colors.

The roles 224 used are orthogonal to the color space metric 310 that is used to define a distance between two given colors. However, which metric 310 is used for a particular difference 308 calculation may depend on whether the colors 216 are serving in the same roles 224. For example, for values 216 in the same role the metric might be CIEDE2000, whereas a metric defining distance between a color value 216 in the foreground role 702 and a color value 216 in the background role 704 might be the contrast ratio defined by the Web Content Accessibility Guidelines (WCAG) 2.1. These are only examples, other metrics 310 may also be employed in embodiments. Similarly, a given embodiment may have colors 216 that are defined in an RGB space 314, a CMYK space 314, or another color space 314.

It is presently contemplated that the most frequent optimizations 212 may include increasing a difference 308, both for different roles 224 and for colors 216 in the same role 224. However, contemplated optimizations 212 include all possible combinations of increasing or decreasing difference 308 for the same or different roles 224.

In some embodiments, the preliminary color palette 302 and the optimized color palette 304 both define the same two or more coloring roles 224, and there is at least one active 316 color palette goal 222 that specifies at least one of the following: changing 902 a color difference 308 between a first coloring role and a second coloring role; changing 902 a first display item color difference 308 between a first coloring role and a second coloring role in a first display item while maintaining 904 a second display item color difference between the first coloring role and the second coloring role in a second display item; or changing 902 a color difference 308 between a first display item color in a coloring role in a first display item and a second display item color in the coloring role in a second display item. An active color palette goal 222 is a color palette goal 222 which is active 316. Similarly, an active color palette constraint 220 is a color palette constraint 220 which is active 316.

The following are some examples of changing 902 a color difference 308 between a first coloring role and a second coloring role: changing a text's foreground color without changing the text's background color, changing a text's background color without changing the text's foreground color, changing the text's foreground and background colors to move them closer to each other, and changing the text's foreground and background colors to move them further apart from each other. These are referred to below as "2A examples".

Other examples can be built using the 2A examples. Some examples denoted here as "2B examples" include changing 902 a first display item color difference 308 between a first coloring role and a second coloring role in a first display item while maintaining 904 a second display item color difference between the first coloring role and the second coloring role in a second display item. Thus, performing a 2A example in the first display item without changing the second display item results in a 2B example. For instance, if one display item is the word "RED" and the other display item is the word "GREEN" then changing the background in RED but not in GREEN would be a 2B change.

Some 2C examples also include two display items. With 2C, color changes are in one role and there is no requirement to maintain a difference in one of the display items. The 2C examples include changing 902 a color difference 308 between a first display item color in a coloring role in a first display item and a second display item color in the coloring role in a second display item. Thus, changing the background in RED but not in GREEN would be a 2C change as well as being a 2B change. However, changing the background both in RED and in GREEN would be a 2C change, but not a 2B change. One of skill will recognize that many other examples of 2A, 2B, or 2C changes are also possible.

In some embodiments, the display 126 includes a focus area 226 and a non-focus area 228, and at least one active color palette goal 222 specifies at least one of the following: increasing 910 a color difference 308 between a first display item in the focus area 226 and a second display item in the non-focus area 228; providing 906 a color difference gradient 908 between a first display item in the focus area 226 and a second display item in the non-focus area 228; or increasing 910 a color difference 308 between a first display item which is in the focus area 226 and which has a first coloring role 224 and a second display item which also has the first coloring role 224 but is in the non-focus area 228.

An example which increases 910 a color difference 308 between a first display item in the focus area 226 and a second display item in the non-focus area 228 would be changing color to emphasize a focus area such as an area around a text insertion point or around a mouse cursor location. Here, as elsewhere herein, changing color means changing one or more colors unless only a single color is clearly the subject of the change.

As an analogy, one may imagine the focus area 226 being viewed through a tinted optical lens while the rest of the display 126 is viewed through clear glass or through no glass at all. However, more visual effects are possible with focus area emphasis than with a tinted lens. For instance, the difference between foreground and background could be increased by focus area emphasis 212 without necessarily moving both the foreground and the background in the same direction, the way a tinted lens would.

Moreover, the focus area 226 does not necessarily have a sharp edge resembling a physical lens edge. The focus area could instead, for example, have a soft edge that blends more smoothly into the non-focus area. This blending 212 may be done, e.g., by providing 906 a color difference gradient 908 between the first display item in the focus area and the second display item in the non-focus area. Blending could be a function of distance from a focus area center point, for example.

An example which increases 910 a color difference 308 between a first display item which is in the focus area and which has a first coloring role and a second display item which also has the first coloring role but is in the non-focus area would be to differentiate foreground 702 text in the focus area 226 from foreground 702 text in the non-focus area 228. For instance, the foreground in a word that contains the focus area center could be changed to move further away from the background 704 color, while the foreground color elsewhere is not changed.

More generally, in some embodiments a color palette goal 222 may vary according to the screen distance between the first display item and the second display item. For instance, in one example goals 222 specify that colors 216 from the foreground palette have a CIEDE2000 (a metric 310) difference of at least 10.0 when they appear within one hundred pixels 330 of each other, or have a CIEDE2000 difference of at least 5.0 when they appear within three hundred pixels 330 of each other, and no specific rule if they do not appear within 300 pixels of each other anywhere on screen. In a variation, the differences are given as ranges instead of minimums, e.g., goals 222 specify a foreground difference of 9.5 to 10.5 for items 208 within one hundred pixels of each other, and a difference of 4.6 to 5.4 for items 208 within three hundred pixels of each other. The goals are prioritized in this example, since some items could satisfy both goal conditions, e.g., when two items are eighty pixels apart they are within one hundred pixels and they are also within three hundred pixels.

In some embodiments, a goal 222 is applied only when the first display item and the second display item are located within the same region of a display, e.g., within a rectangular central ninth of the displayed image. Some other examples include goals that: restrict a contrast ratio as defined by the Web Content Accessibility Guidelines (WCAG) 2.1 of a foreground role 702 to a background role 704 in the non-focus area to at most 5.0, restrict color difference of foreground role 702 and adornment role 708 pairs in the non-focus area to at most half of an average difference observed in the preliminary color palette 302, ensure each pair of non-equal colors selected from the foreground role 702 have a CIEDE2000 difference of 5.0 or greater in the focus area, or ensure branding 320 colors are not altered from corporate-assigned values 216 when they appear in the focus area.

The foregoing examples may be expanded upon in various ways. Among these are a use of different roles 224, different metrics 310, different combinations of minimums or maximums or ranges, different numeric values for minimums or maximums or ranges, and whether a rule 342 is specified as a goal 222 or as a constraint 220. Other variations in examples may also be of interest to one of skill in the art in view of the teachings provided herein.

In some embodiments, the display 126 includes a focus area 226 and a non-focus area 228, and the at least one active color palette constraint 220 specifies at least one of the following: limiting 916 a color difference 308 between a replaced color 322 of the preliminary color palette and replacement color 324 which replaces the replaced color in the optimized color palette (e.g., brown still looks like brown after optimization); limiting 916 a color difference 308 between a replaced color 322 of the preliminary color palette 302 which at least partially fills a coloring role 224, and a replacement color 324 which replaces the replaced color in the optimized color palette 304 and also at least partially fills the coloring role (e.g., highlighting still looks like highlighting after optimization); or limiting 916 a color spacing difference 326 between a set 328 of replaced colors of the preliminary color palette and a set 328 of replacement colors which replaces the set of replaced colors in the optimized color palette (e.g., the spacing between foreground and background is about the same after optimization even if the foreground colors and background colors themselves change a lot, so legibility is likely to be preserved).

One of skill informed by the teachings herein will acknowledge that color perception can involve a physiological ability of a person to differentiate between two colors 216, or a physical response to one or more colors 216, or an emotional response to one or more colors 216, or a mix thereof. In some embodiments, physical color differentiation disabilities are partially or fully compensated 212 through color mappings 230 using a difference metric function 310. In some embodiments, emotional responses to color are mediated or otherwise compensated 212 through goals 222 or constraints 220 or both.

Some embodiments use or include a perception compensation mapping 230 which specifies at least one of the following: an isometry 402 between the preliminary color palette and the optimized color palette (colors stay the same distance apart); a tolerance isometry 404 between the preliminary color palette and the optimized color palette (colors stay about the same distance apart plus or minus a specified tolerance 418); a mapping 230 which transforms color differences in a trichromatic space 406 to color differences in a fully dichromatic space 408 (so-called "normal" color vision to full "colorblindness" of any variety; quotes in this paragraph recognize that the quoted terms are not necessarily preferable despite their longstanding use); a mapping 230 which transforms color differences in a trichromatic space 406 to color differences in a protanopic space 410 ("red weakness" compensation); a mapping 230 which transforms color differences in a trichromatic space 406 to color differences in a deuteranopic space 412 ("green weakness" compensation); a mapping 230 which transforms color differences in a trichromatic space 406 to color differences in a tritanopic space 414 (blue-yellow "colorblindness"); a mapping 230 which transforms color differences in a trichromatic space 406 to color differences in a monochromatic space 416 (grayscale); or a mapping 230 which transforms color differences in a trichromatic space 406 to color differences in a space 420 optimized for viewers with autism 422, with an attention deficit disorder 424, with a cognitive learning challenge 426, or with another diagnosed condition characterized at least in part by an emotional response to one or more colors. Existing palettes 218 and spaces 314 may be implemented into mappings, as may palettes or spaces defined hereafter. In some cases, an isometry may not be feasible due to limitations in a user's color perception. In such cases, a close viable mapping may be substituted or used.

Other system embodiments are also described herein, either directly or derivable as system versions of described processes or configured media, duly informed by the extensive discussion herein of computing hardware.

Although specific adaptive recoloring architecture examples are shown in the Figures, an embodiment may depart from those examples. For instance, items shown in different Figures may be included together in an embodiment, items shown in a Figure may be omitted, functionality shown in different items may be combined into fewer items or into a single item, items may be renamed, or items may be connected differently to one another.

Examples are provided in this disclosure to help illustrate aspects of the technology, but the examples given within this document do not describe all of the possible embodiments. A given embodiment may include additional or different technical features 724, goals 222, constraints 220, specific recoloring 212, user interface mechanisms, operational sequences, data structures, or other functionalities for instance, and may otherwise depart from the examples provided herein.

Processes (a.k.a. Methods)

Figure 8:
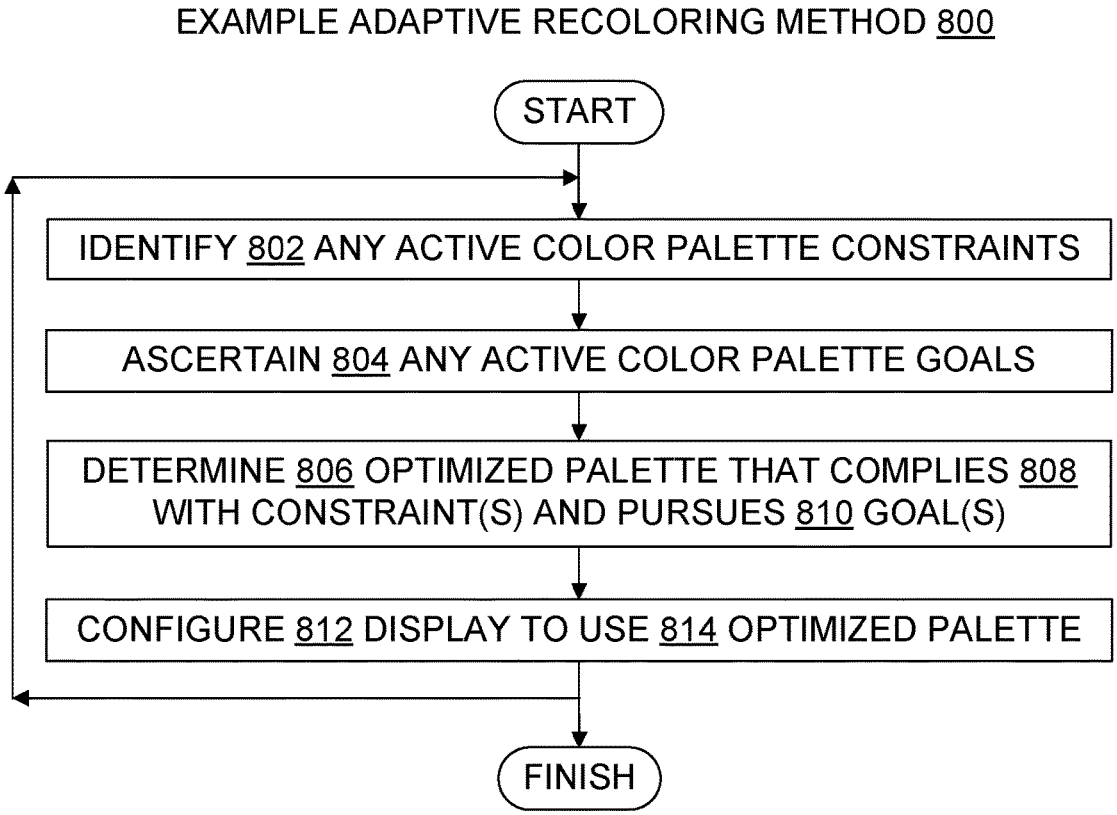
FIG. 8 is a flowchart illustrating steps in some adaptive recoloring methods.
Figure 9:
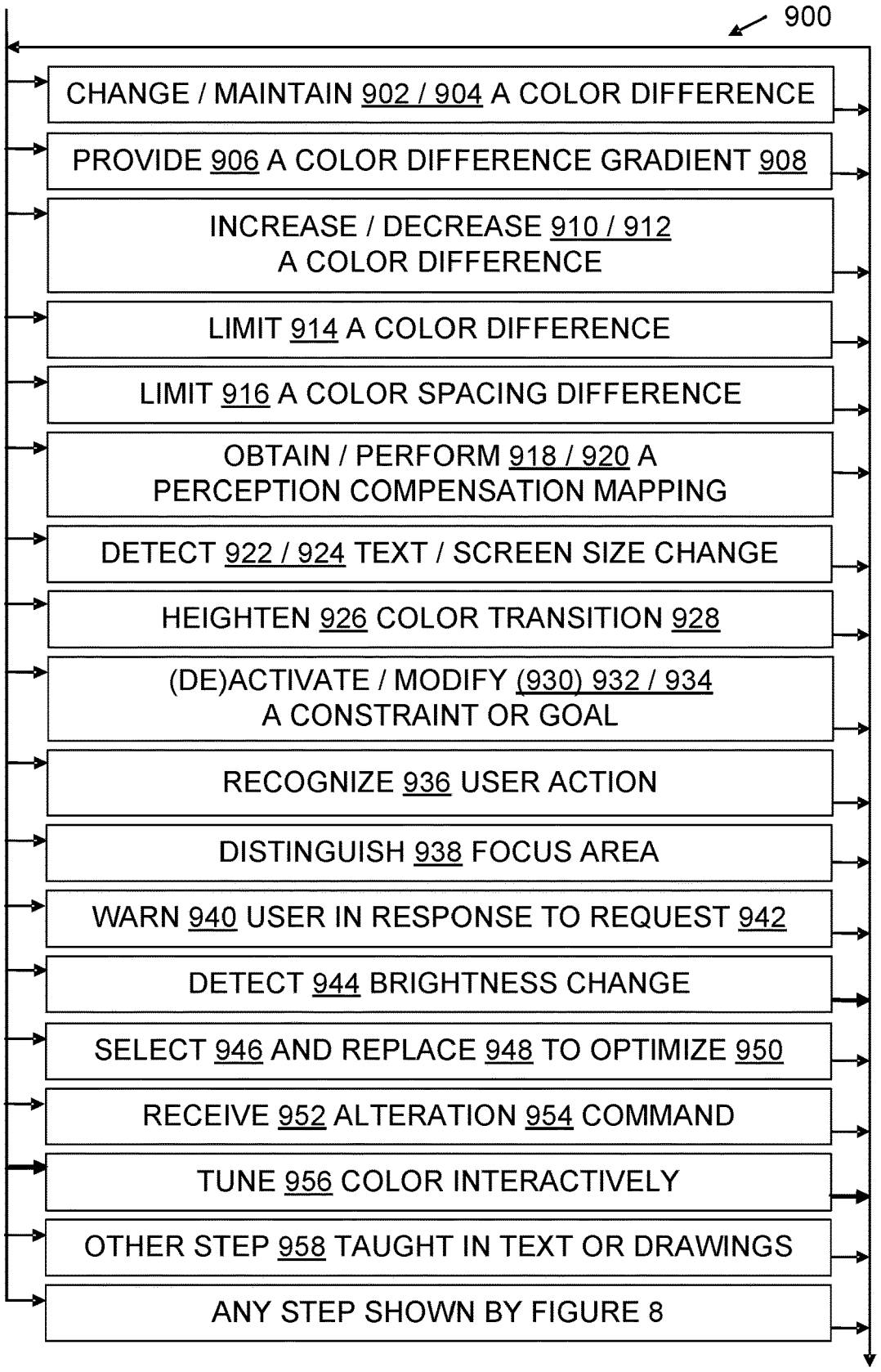
FIG. 9 is a flowchart further illustrating steps in some adaptive recoloring methods, and incorporating FIG. 8.

FIGS. 8 and 9 illustrate operational sequences, which may be part of process embodiments or be performed by system embodiments, for example. FIG. 8 illustrates a family of methods 800 that may be performed or assisted by an enhanced system, such as system 202 or another adaptive recoloring 212 functionality enhanced system as taught herein. FIG. 9 further illustrates adaptive recoloring methods (which may also be referred to as "processes" in the legal sense of that word) that are suitable for use during operation of a system which has innovative functionality taught herein. FIG. 9 includes some refinements, supplements, or contextual actions for steps shown in FIG. 8, and incorporates the steps of FIG. 8 as options.

Technical processes shown in the Figures or otherwise disclosed will be performed automatically, e.g., by an enhanced editor 204, unless otherwise indicated. Processes may also be performed in a context that is part automatic and part manual to the extent action by a human person is implicated, e.g., in some embodiments a human may manually type keys or operate a mouse to guide creation or insertion of text or other content 214, but no process contemplated as innovative herein is entirely manual. In particular, manually changing colors without automatic recoloring is not a focus of teachings herein. Reliance on manual color change is also impractical in many situations, e.g., due to the interruptions in workflow involved, inability to access underlying palettes through a user interface, and the vast number of available colors.

In a given embodiment zero or more illustrated steps of a process may be repeated, perhaps with different parameters or data to operate on. Steps in an embodiment may also be done in a different order than the top-to-bottom order that is laid out in FIGS. 8 and 9. Steps may be performed serially, in a partially overlapping manner, or fully in parallel. In particular, the order in which flowchart 800 or 900 action items are traversed to indicate the steps performed during a process may vary from one performance of the process to another performance of the process. The flowchart traversal order may vary from one process embodiment to another process embodiment. Operational sequences may differ from those shown in FIGS. 8 and 9. Steps may also be omitted, combined, renamed, regrouped, be performed on one or more machines, or otherwise depart from the illustrated flow, provided that the process performed is operable and conforms to at least one claim.

Some embodiments use or provide a method 900 for adaptively recoloring a display 126. Some methods include the following steps performed automatically and proactively: identifying 802 one or more active color palette constraints 220; ascertaining 804 one or more active color palette goals 222; determining 806 an optimized color palette 304 which is closer to at least one active color palette goal 222 than a preliminary color palette 302 and which is compliant with all active color palette constraints 220; and configuring 812 at least a portion of the display 126 to use 814 the optimized color palette in place of the preliminary color palette.

In some variations, constraints 220 are not identified, and the optimized color palette 304 is closer to at least one active color palette goal 222 than the preliminary color palette 302, without regard to constraints. In some variations, goals 222 are not ascertained, and the optimized color palette 304 is compliant with all active color palette constraints 220, without regard to goals.

In some embodiments, determining 806 an optimized color palette includes at least one of the following: increasing 910 a difference 308 between coloring roles 224 in response to detecting 922 a decrease in a physical dimension of a displayed text (e.g., increase foreground vs background difference when text gets physically smaller, regardless of screen size); decreasing 912 a difference 308 between coloring roles 224 in response to detecting 922 an increase in a physical dimension of a displayed text (decrease difference when text gets physically bigger, regardless of screen size); increasing 910 a difference 308 between coloring roles 224 in response to detecting 924 use of a screen which has a physical dimension below a specified threshold (e.g., increase difference when text is on a smartphone because screen is smaller); or decreasing 912 a difference 308 between coloring roles 224 in response to detecting 924 use of a screen which has a physical dimension above a specified threshold (e.g., decrease difference when text is on a tablet or laptop or TV screen).

In some embodiments, determining 806 an optimized color palette includes recognizing 936 a user action 332 which indicates a focus area 226 of the display 126, and distinguishing 938 the focus area from a non-focus area 228 in at least one of the following ways: applying 808 an area-specific color palette constraint 220, or pursuing 810 an area-specific color palette goal 222. For instance, an embodiment may increase the perceived difference between a focus area and at least part of the rest of the display in response to a zoom 608, a mouse click to move the text insertion point, a hovering mouse cursor, tracked user eye movements, or anything other user action that indicates a change in what the user is focused on, or in what the user should be focused on.

A text insertion point of a document in an editor is the location where typed or pasted text would be inserted. It may be indicated by a vertical bar |, or by some other visual indicator, or it may be present without a visual indicator. In editors that recognize multiple input devices, such as a keyboard and a mouse, a distinction may be made between a text insertion point and a cursor location. A cursor may be positioned by mouse movements without changing the text insertion point, and the text insertion point may change without moving the mouse cursor. Sometimes a mouse operation, e.g., a double-click, may be used to change the text insertion point to match the mouse cursor location.

Some embodiments include at least one of the following: deactivating 930 an active color palette constraint in response to a user action; deactivating 930 an active color palette goal in response to a user action; modifying 934 an active color palette constraint in response to a user action; modifying 934 an active color palette goal in response to a user action; in response to a user action requesting 942 a change to a color, warning 940 the user that changing the color as requested will violate an active color palette constraint (e.g., warn the user that the requested color change will violate a minimum difference between foreground and background colors); or in response to a user action requesting 942 a change to a color, warning 940 the user that changing the color as requested will hinder pursuit of an active color palette goal (e.g., warn the user that the requested color change will make two syntax adornments harder to tell apart). Thus, in some embodiments a user 104 can explicitly or implicitly override 930 a constraint 220, or a goal 222, or both. The user could also leave the rule 342 active but modify 934 it.

In some embodiments, determining 806 an optimized color palette includes at least one of the following: increasing 910 a difference 308 between coloring roles 224 only within a focus area of the display; or decreasing 912 a difference between coloring roles only within a non-focus area of the display.

In some embodiments, determining 806 an optimized color palette includes heightening 926 a color transition 928 between a pair of adjacent words 208, the pair including a first word and a second word, such that a color difference 308 between a first pixel 330 at a first location 312 in the first word and a second pixel 330 at a second location 312 in the second word increases 910 as a screen distance 504 between the first location and the second location reduces.

For instance, consider the phrase "new car" as example text in which the first word is "new" and the second word is "car". As a terminology note, although "first" and "second" happen to match the order here, in general the use of "first", "second", and so on in claims merely indicates distinct items without necessarily imposing an order on those items. In a typical editor, the foreground color would often be the same throughout "new car", e.g., black, and the background color would also be the same throughout "new car", e.g., white. Thus, in terms of color differences, a hypothetical transition between "n" and "e" is the same as one between "w" and "c" or one between "a" and "r".

But in some embodiments of an enhanced editor 204, this uniformity is not always present. The transition between the words could be heighted 926 relative to the transitions within each respective word. Using the difference between underlined and non-underlined as an analog of different colors, the editor 204 could display the coloring analog of "new car" (the "w" is underlined). That is, recoloring to heighten the transition from "new" to "car" could make the "w" a different foreground color than the other letters in "new car".

Moreover, color could change within a word and even within a character, so that the leftmost portion of the "n" is a different color than the rightmost portion of the "n", which is in turn a different color than the leftmost portion of the "e", which is a different color than the rightmost portion of the "e", and so on, to gradually move further and further away from the color of the leftmost portion of the "c", thus increasing the perceived difference between the two words. The gradation could also start later, e.g., within the "e".

In some embodiments, determining 806 an optimized color palette includes at least one of the following: increasing 910 a difference 308 between coloring roles 224 in response to detecting 944 a decrease in a display brightness 334 (e.g., increase foreground versus background difference when the display gets darker); decreasing 912 a difference 308 between coloring roles 224 in response to detecting 944 an increase in a display brightness 334 (decrease difference when display gets brighter); increasing 910 a difference 308 between coloring roles 224 in response to detecting 944 a decrease in an ambient brightness 336; or decreasing 912 a difference 308 between coloring roles 224 in response to detecting 944 an increase in an ambient brightness 336. Notably, by utilizing recoloring 212 to maintain legibility despite decreased screen brightness or increased ambient brightness, and enhanced device 102 may save battery power. Without such recoloring 212, maintaining legibility might be attempted by increasing screen brightness, which would consume more power than maintaining the screen brightness and recoloring.

In some embodiments, determining 806 an optimized color palette includes: selecting 946 a color which is not in the preliminary color palette but is closer to a nearby preliminary palette color than is permitted by an active color palette distance constraint; and replacing 948 the nearby preliminary palette color with a replacement color that satisfies the active color palette distance constraint. As a result, the optimized color palette includes the selected color, and all colors in the optimized palette satisfy the active color palette distance constraint. A scenario like this is discussed above, in the discussion of adding a proposed color assignment to the innovator's Visual Studio® deployment. One technical effect of this optimization is to make better use of available colors, by selecting more colors that are different enough for an expected viewer 104 to tell them apart, by changing some existing colors to make room for a new color without altering the viewer's perception of the existing colors.

Some embodiments perform syntax highlighting 338. The syntax highlighting 338 employs two or more colors of the optimized color palette. In some embodiments, the syntax highlighting 338 also employs at least one color that is in the optimized color palette and not in the preliminary color palette.

In some embodiments, determining 806 an optimized color palette includes: displaying 814 at least two colors; receiving 952 a color alteration command 306 though a user interface 206; altering 954 at least one color based on the color alteration command; and updating 814 the display to reflect the color altering. In this manner, the optimized color palette is specified at least in part by interactive color tuning 956. A tuner 428 mechanism such as a color picker, slider, or dialog box may be used to obtain the color alteration command.

Configured Storage Media

Some embodiments include a configured computer-readable storage medium 112, which may also be referred to as a storage device 112. Storage medium 112 may include disks (magnetic, optical, or otherwise), RAM, EEPROMS or other ROMs, and/or other configurable memory, including in particular computer-readable storage media (which are not mere propagated signals). The storage medium which is configured may be in particular a removable storage medium 114 such as a CD, DVD, or flash memory. A general-purpose memory, which may be removable or not, and may be volatile or not, can be configured into an embodiment using items such as color palettes 218, 302, 304, recoloring rules 220, 222, coloring role data structures 224, color space metric functions 310, and adaptive recoloring software 210, in the form of data 118 and instructions 116, read from a removable storage medium 114 and/or another source such as a network connection, to form a configured storage medium. The configured storage medium 112 is capable of causing a computer system 102 to perform technical process steps for adaptive recoloring, as disclosed herein. The Figures thus help illustrate configured storage media embodiments and process (a.k.a. method) embodiments, as well as system and process embodiments. In particular, any of the process steps illustrated in FIG. 8 or 9, or otherwise taught herein, may be used to help configure a storage medium to form a configured storage medium embodiment.

Some embodiments use or provide a computer-readable storage medium 112, 114 configured with data 118 and instructions 116 which upon execution by at least one processor 110 cause a computing system to perform a method for adaptively recoloring a display. This method includes automatically: identifying 802 one or more active color palette constraints; ascertaining 804 one or more active color palette goals; determining 806 an optimized color palette which is closer to at least one active color palette goal than a preliminary color palette and which is compliant with all active color palette constraints; and configuring 812 at least a portion of a display to use the optimized color palette in place of the preliminary color palette.

Some embodiments include both the configured storage device and the display 126. In some of these, the display includes at least one of the following: a screen 502; a projector 506; a device 126 which is configured to show a two-dimensional image 508; or a device 126 which is configured to show a three-dimensional image 510. In short, adaptive recoloring 212 may be performed with a variety of displays, and in particular is not inherently limited to two-dimensional images or to devices with screens such as laptops and smartphones.

In some embodiments, configuring 812 the display includes displaying 814 at least one of the following in an image that includes at least two colors of the optimized color palette: a source code text 606; a natural language text 604 (alphabetic, ideographic, phonetic, or otherwise); a mathematical expression 614; a line drawing 616 (e.g., computer aided design drawings, patent drawings); a logo 620; or a photograph derivative 622. A digital photograph 624 is a photograph derivative 622, and so is a result of manipulating content of the photograph 624 using graphics design software, paint software, filters, or other image manipulation or image processing or image recognition software.

In some embodiments, determining 806 an optimized color palette includes recognizing a user zooming action 332, 608 which indicates a focus area of the display, and increasing 910 a color difference between a first display item in the focus area and a second display item in a non-focus area.

In some embodiments, each color palette 302, 304 defines at least two of the following coloring roles 224: a foreground role 702; a background role 704; a selection-based highlighting role 710; a syntax-based highlighting role 716; a dormant role 706; an adornment role 708; an underline role 714; a partial underline role 712; an outline role 718; a warning role 720; or an error role 722.

Additional Examples and Observations, Generally

Additional support for the discussion of adaptive recoloring herein is provided under various headings. However, it is all intended to be understood as an integrated and integral part of the present disclosure's discussion of the contemplated embodiments.

One of skill will recognize that not every part of this disclosure, or any particular details therein, are necessarily required to satisfy legal criteria such as enablement, written description, or best mode. Any apparent conflict with any other patent disclosure, even from the owner of the present innovations, has no role in interpreting the claims presented in this patent disclosure. With this understanding, which pertains to all parts of the present disclosure, additional examples and observations are offered.

In a base form, a preliminary color palette 302 representing foreground (text) and background colors 216, along with a set of rules 342, are input to an optimization program 204. The rules include fixed constraints 220 (e.g., a background color which cannot change, or minimum contrast ratios to meet accessibility requirements), as well as goals 222 for items that can change (e.g., each color should move as little as possible, but users should be able to recognize the difference between two different foreground colors).

A constraint 220 is a rule by which acceptability of a color palette may be determined. For example, standards bodies may require colors in two specific roles 224 to have a specific minimum or maximum difference 308 when evaluated according to a metric that is defined as part of a standard, even if the user cannot recognize the difference between the two colors. Failure to adhere to a constraint could cause a product to fail a certification process or violate a contractual agreement. Another example of a constraint 220 is one specifying colors in the palette which cannot change due to implementation limitations (e.g., the rendering logic is hard-coded to use one color for a specific role, or certain colors are unavailable on certain displays 126 due to firmware or hardware limits, and that color cannot be changed). Branding 320 may also include constraints, e.g., when the colors of a logo 620 cannot be changed, or can only be changed while the logo is outside the focus area 226.

The optimization program 204 adjusts 212 a copy of the color palette 302 (or in some embodiments the actual palette 302 it is given) to produce an output color palette 304 attempting 810 to best meet the stated goals 222 while adhering 808 to the constraints 220. Optimization 950 may be performed using hill climbing or another mathematical optimization heuristic or algorithm, with one or more metrics 310 for RGB or another color space 314 for determining distances between colors 216. Different goals, and different constraints, may employ different respective metrics.

The optimization metric 310 may be dependent on where the colors are located in the color space. For example, suppose two colors BG1 and BG2 in a blue-green portion of a color space have a numerical raw distance of BG12distance, and suppose two colors RO1 and RO2 in a red-orange portion of the color space have a numerical raw distance of RO12distance. Then an optimization metric 310 may weight or otherwise adjust the raw distance(s) such that the metric's distance between BG1 and BG2 is the same as the metric's distance between RO1 and RO2 even though BG12distance is less than RO12distance.

The base form can be expanded to a more fully automated solution, where foreground colors or background colors, for example, of a program 204 are automatically adjusted 212 during rendering. The program 204 may be a text editor 204 with syntax highlighting 338 or other functionality that is shown using colors. In this expanded form, an optimization goal 222 might be increasing the user's ability to recognize the difference between colors that are in on-screen proximity to each other, while minimizing a risk of user distraction from any adjustments made to the desired colors. Another goal 222 might be forcing contrast ratios to adhere to specific minimum values as defined by the known color combinations appearing on screen along with the font size. For instance, zooming out 608 produces smaller text, which in turn calls for higher minimum contrast ratios.

Such an automated solution can further account 230 for differences in perceived colors for known "colorblindness" conditions, and optimize to pursue the desired goals in the context of that viewer 104 condition. Accounting for physical proximity of the colors 216 actively rendered can overcome challenges of using a limited color space 314 such as a space 408, 410, 412, 414, 416, or 420.

Such an automated solution can further account for individual user preferences by allowing users to provide additional goals 222 for the optimization process. For example, users wishing to better distinguish between two specific colors that tend to appear in text could provide 956 a command 306 that these colors should move further from their original positions in order to meet a goal of distinguishing between them. While manually adjusting 956 colors, users might be shown 940 a warning if known rules are not met by the colors, or if two colors are similar enough that confusion is likely. In such a scenario, the user could be provided the option of automatically choosing a new color for a display item which better meets the goals, e.g., by application of the base form, with requirements augmented to only allow changes to items the user wants to modify.

Another recoloring usage scenario is application of adaptive recoloring to presentation material (e.g., shared slides or video) by a participant in a live or recorded presentation. This could improve the ability of some users to participate in meetings through videoconferencing.

Technical Character

The technical character of embodiments described herein will be apparent to one of ordinary skill in the art, and will also be apparent in several ways to a wide range of attentive readers. Some embodiments address technical activities such as displaying 814 colors on a display screen 502, measuring distances between digital colors 216, computationally mapping 230 between digital color spaces 314, highlighting 338 source code 610 based on syntax 340, or detecting 922 zoom 608 actions 332, which are each an activity deeply rooted in computing technology. Some of the technical mechanisms discussed include, e.g., digital colors 216, color palette data structures 218, color palette constraints 220 and goals 222 implemented in software 210, color palette mappings 230, and focus areas 226. Some of the technical effects discussed include, e.g., improving text legibility by adaptive color differencing 212, assisting user focus by dynamically recoloring 212 in-focus-area display items 208 so they are different than display items outside the focus area 226, mapping 230 to compensate for differences in the perception of colors or in the emotional impact of colors, saving battery power, and recoloring 946 and 948 to increase color availability without degrading usability. Branding colors 320 may nonetheless be preserved, and automatic selections may be overridden 306. Thus, purely mental processes and activities limited to pen-and-paper are clearly excluded. Other advantages based on the technical characteristics of the teachings will also be apparent to one of skill from the description provided.

Some embodiments described herein may be viewed by some people in a broader context. For instance, concepts such as awareness, ease, efficiency, or user satisfaction, may be deemed relevant to a particular embodiment. However, it does not follow from the availability of a broad context that exclusive rights are being sought herein for abstract ideas, they are not. Rather, the present disclosure is focused on providing appropriately specific embodiments whose technical effects fully or partially solve particular technical problems, such as how to automatically help a user focus on a particular area of a screen. Other configured storage media, systems, and processes involving awareness, ease, efficiency, or user satisfaction are outside the present scope. Accordingly, vagueness, mere abstractness, lack of technical character, and accompanying proof problems are also avoided under a proper understanding of the present disclosure.

Additional Combinations and Variations

Any of these combinations of code, data structures, logic, components, communications, and/or their functional equivalents may also be combined with any of the systems and their variations described above. A process may include any steps described herein in any subset or combination or sequence which is operable. Each variant may occur alone, or in combination with any one or more of the other variants. Each variant may occur with any of the processes and each process may be combined with any one or more of the other processes. Each process or combination of processes, including variants, may be combined with any of the configured storage medium combinations and variants described above.

More generally, one of skill will recognize that not every part of this disclosure, or any particular details therein, are necessarily required to satisfy legal criteria such as enablement, written description, or best mode. Also, embodiments are not limited to the particular motivating examples, operating environments, time period examples, software processes, identifiers, data structures, data selections, naming conventions, notations, control flows, or other implementation choices described herein. Any apparent conflict with any other patent disclosure, even from the owner of the present innovations, has no role in interpreting the claims presented in this patent disclosure.

Acronyms, Abbreviations, Names, and Symbols

Some acronyms, abbreviations, names, and symbols are defined below. Others are defined elsewhere herein, or do not require definition here in order to be understood by one of skill.

ALU: arithmetic and logic unit
API: application program interface
BIOS: basic input/output system
CD: compact disc
CPU: central processing unit
DVD: digital versatile disk or digital video disc
FPGA: field-programmable gate array
FPU: floating point processing unit
GPU: graphical processing unit
GUI: graphical user interface
IaaS or IAAS: infrastructure-as-a-service
ID: identification or identity
LAN: local area network
OS: operating system
PaaS or PAAS: platform-as-a-service
RAM: random access memory
ROM: read only memory
TPU: tensor processing unit
UEFI: Unified Extensible Firmware Interface
WAN: wide area network

Some Additional Terminology

Reference is made herein to exemplary embodiments such as those illustrated in the drawings, and specific language is used herein to describe the same. But alterations and further modifications of the features illustrated herein, and additional technical applications of the abstract principles illustrated by particular embodiments herein, which would occur to one skilled in the relevant art(s) and having possession of this disclosure, should be considered within the scope of the claims.

The meaning of terms is clarified in this disclosure, so the claims should be read with careful attention to these clarifications. Specific examples are given, but those of skill in the relevant art(s) will understand that other examples may also fall within the meaning of the terms used, and within the scope of one or more claims. Terms do not necessarily have the same meaning here that they have in general usage (particularly in non-technical usage), or in the usage of a particular industry, or in a particular dictionary or set of dictionaries. Reference numerals may be used with various phrasings, to help show the breadth of a term. Omission of a reference numeral from a given piece of text does not necessarily mean that the content of a Figure is not being discussed by the text. The inventor asserts and exercises the right to specific and chosen lexicography. Quoted terms are being defined explicitly, but a term may also be defined implicitly without using quotation marks. Terms may be defined, either explicitly or implicitly, here in the Detailed Description and/or elsewhere in the application file.

A "computer system" (a.k.a. "computing system") may include, for example, one or more servers, motherboards, processing nodes, laptops, tablets, personal computers (portable or not), personal digital assistants, smartphones, smartwatches, smartbands, cell or mobile phones, other mobile devices having at least a processor and a memory, video game systems, augmented reality systems, holographic projection systems, televisions, wearable computing systems, and/or other device(s) providing one or more processors controlled at least in part by instructions. The instructions may be in the form of firmware or other software in memory and/or specialized circuitry.

A "multithreaded" computer system is a computer system which supports multiple execution threads. The term "thread" should be understood to include code capable of or subject to scheduling, and possibly to synchronization. A thread may also be known outside this disclosure by another name, such as "task," "process," or "coroutine," for example. However, a distinction is made herein between threads and processes, in that a thread defines an execution path inside a process. Also, threads of a process share a given address space, whereas different processes have different respective address spaces. The threads of a process may run in parallel, in sequence, or in a combination of parallel execution and sequential execution (e.g., time-sliced).

A "processor" is a thread-processing unit, such as a core in a simultaneous multithreading implementation. A processor includes hardware. A given chip may hold one or more processors. Processors may be general purpose, or they may be tailored for specific uses such as vector processing, graphics processing, signal processing, floating-point arithmetic processing, encryption, I/O processing, machine learning, and so on.

"Kernels" include operating systems, hypervisors, virtual machines, BIOS or UEFI code, and similar hardware interface software.

"Code" means processor instructions, data (which includes constants, variables, and data structures), or both instructions and data. "Code" and "software" are used interchangeably herein. Executable code, interpreted code, and firmware are some examples of code.

"Program" is used broadly herein, to include applications, kernels, drivers, interrupt handlers, firmware, state machines, libraries, and other code written by programmers (who are also referred to as developers) and/or automatically generated.

A "routine" is a callable piece of code which typically returns control to an instruction just after the point in a program execution at which the routine was called. Depending on the terminology used, a distinction is sometimes made elsewhere between a "function" and a "procedure": a function typically returns a value, while a procedure does not. As used herein, "routine" includes both functions and procedures. A routine may have code that returns a value (e.g., sin(x)) or it may simply return without also providing a value (e.g., void functions).

"Service" means a consumable program offering, in a cloud computing environment or other network or computing system environment, which provides resources to multiple programs or provides resource access to multiple programs, or does both.

"Cloud" means pooled resources for computing, storage, and networking which are elastically available for measured on-demand service. A cloud may be private, public, community, or a hybrid, and cloud services may be offered in the form of infrastructure as a service (IaaS), platform as a service (PaaS), software as a service (SaaS), or another service. Unless stated otherwise, any discussion of reading from a file or writing to a file includes reading/writing a local file or reading/writing over a network, which may be a cloud network or other network, or doing both (local and networked read/write). A cloud may also be referred to as a "cloud environment" or a "cloud computing environment".

"Access" to a computational resource includes use of a permission or other capability to read, modify, write, execute, move, delete, create, or otherwise utilize the resource. Attempted access may be explicitly distinguished from actual access, but "access" without the "attempted" qualifier includes both attempted access and access actually performed or provided.

As used herein, "include" allows additional elements (i.e., includes means comprises) unless otherwise stated.

"Optimize" means to improve, not necessarily to perfect. For example, it may be possible to make further improvements in a program or an algorithm which has been optimized.

"Process" is sometimes used herein as a term of the computing science arts, and in that technical sense encompasses computational resource users, which may also include or be referred to as coroutines, threads, tasks, interrupt handlers, application processes, kernel processes, procedures, or object methods, for example. As a practical matter, a "process" is the computational entity identified by system utilities such as Windows® Task Manager, Linux® ps, or similar utilities in other operating system environments (marks of Microsoft Corporation, Linus Torvalds, respectively). "Process" is also used herein as a patent law term of art, e.g., in describing a process claim as opposed to a system claim or an article of manufacture (configured storage medium) claim. Similarly, "method" is used herein at times as a technical term in the computing science arts (a kind of "routine") and also as a patent law term of art (a "process"). "Process" and "method" in the patent law sense are used interchangeably herein. Those of skill will understand which meaning is intended in a particular instance, and will also understand that a given claimed process or method (in the patent law sense) may sometimes be implemented using one or more processes or methods (in the computing science sense).

"Automatically" means by use of automation (e.g., general purpose computing hardware configured by software for specific operations and technical effects discussed herein), as opposed to without automation. In particular, steps performed "automatically" are not performed by hand on paper or in a person's mind, although they may be initiated by a human person or guided interactively by a human person. Automatic steps are performed with a machine in order to obtain one or more technical effects that would not be realized without the technical interactions thus provided. Steps performed automatically are presumed to include at least one operation performed proactively.

One of skill understands that technical effects are the presumptive purpose of a technical embodiment. The mere fact that calculation is involved in an embodiment, for example, and that some calculations can also be performed without technical components (e.g., by paper and pencil, or even as mental steps) does not remove the presence of the technical effects or alter the concrete and technical nature of the embodiment, particularly in real-world embodiment implementations. Adaptive recoloring operations such as displaying 814 colors on a screen 502, measuring distances between colors 216, mapping 230 between color spaces 314, highlighting 338 source code 610 based on syntax 340, or detecting 922 zoom 608 actions 332, and many other operations discussed herein, are understood to be inherently digital. A human mind cannot interface directly with a CPU or other processor, or with RAM or other digital storage, to read and write the necessary data to perform the adaptive recoloring steps taught herein. This would all be well understood by persons of skill in the art in view of the present disclosure.

"Computationally" likewise means a computing device (processor plus memory, at least) is being used, and excludes obtaining a result by mere human thought or mere human action alone. For example, doing arithmetic with a paper and pencil is not doing arithmetic computationally as understood herein. Computational results are faster, broader, deeper, more accurate, more consistent, more comprehensive, and/or otherwise provide technical effects that are beyond the scope of human performance alone. "Computational steps" are steps performed computationally. Neither "automatically" nor "computationally" necessarily means "immediately". "Computationally" and "automatically" are used interchangeably herein.

"Proactively" means without a direct request from a user. Indeed, a user may not even realize that a proactive step by an embodiment was possible until a result of the step has been presented to the user. Except as otherwise stated, any computational and/or automatic step described herein may also be done proactively.

Throughout this document, use of the optional plural "(s)", "(es)", or "(ies)" means that one or more of the indicated features is present. For example, "processor(s)" means "one or more processors" or equivalently "at least one processor".

For the purposes of United States law and practice, use of the word "step" herein, in the claims or elsewhere, is not intended to invoke means-plus-function, step-plus-function, or 35 United State Code Section 112 Sixth Paragraph/Section 112(f) claim interpretation. Any presumption to that effect is hereby explicitly rebutted.

For the purposes of United States law and practice, the claims are not intended to invoke means-plus-function interpretation unless they use the phrase "means for". Claim language intended to be interpreted as means-plus-function language, if any, will expressly recite that intention by using the phrase "means for". When means-plus-function interpretation applies, whether by use of "means for" and/or by a court's legal construction of claim language, the means recited in the specification for a given noun or a given verb should be understood to be linked to the claim language and linked together herein by virtue of any of the following: appearance within the same block in a block diagram of the figures, denotation by the same or a similar name, denotation by the same reference numeral, a functional relationship depicted in any of the figures, a functional relationship noted in the present disclosure's text. For example, if a claim limitation recited a "zac widget" and that claim limitation became subject to means-plus-function interpretation, then at a minimum all structures identified anywhere in the specification in any figure block, paragraph, or example mentioning "zac widget", or tied together by any reference numeral assigned to a zac widget, or disclosed as having a functional relationship with the structure or operation of a zac widget, would be deemed part of the structures identified in the application for zac widgets and would help define the set of equivalents for zac widget structures.

One of skill will recognize that this innovation disclosure discusses various data values and data structures, and recognize that such items reside in a memory (RAM, disk, etc.), thereby configuring the memory. One of skill will also recognize that this innovation disclosure discusses various algorithmic steps which are to be embodied in executable code in a given implementation, and that such code also resides in memory, and that it effectively configures any general-purpose processor which executes it, thereby transforming it from a general-purpose processor to a special-purpose processor which is functionally special-purpose hardware.

Accordingly, one of skill would not make the mistake of treating as non-overlapping items (a) a memory recited in a claim, and (b) a data structure or data value or code recited in the claim. Data structures and data values and code are understood to reside in memory, even when a claim does not explicitly recite that residency for each and every data structure or data value or piece of code mentioned. Accordingly, explicit recitals of such residency are not required. However, they are also not prohibited, and one or two select recitals may be present for emphasis, without thereby excluding all the other data values and data structures and code from residency. Likewise, code functionality recited in a claim is understood to configure a processor, regardless of whether that configuring quality is explicitly recited in the claim.

Throughout this document, unless expressly stated otherwise any reference to a step in a process presumes that the step may be performed directly by a party of interest and/or performed indirectly by the party through intervening mechanisms and/or intervening entities, and still lie within the scope of the step. That is, direct performance of the step by the party of interest is not required unless direct performance is an expressly stated requirement. For example, a step involving action by a party of interest such as activating, ascertaining, changing, complying, configuring, deactivating, decreasing, detecting, determining, displaying, distinguishing, heightening, identifying, increasing, limiting, obtaining, performing, providing, pursuing, receiving, recognizing, replacing, selecting, tuning, warning, zooming (and activates, activated, ascertains, ascertained, etc.) with regard to a destination or other subject may involve intervening action such as the foregoing or forwarding, copying, uploading, downloading, encoding, decoding, compressing, decompressing, encrypting, decrypting, authenticating, invoking, and so on by some other party, including any action recited in this document, yet still be understood as being performed directly by the party of interest.

Whenever reference is made to data or instructions, it is understood that these items configure a computer-readable memory and/or computer-readable storage medium, thereby transforming it to a particular article, as opposed to simply existing on paper, in a person's mind, or as a mere signal being propagated on a wire, for example. For the purposes of patent protection in the United States, a memory or other computer-readable storage medium is not a propagating signal or a carrier wave or mere energy outside the scope of patentable subject matter under United States Patent and Trademark Office (USPTO) interpretation of the In re Nuijten case. No claim covers a signal per se or mere energy in the United States, and any claim interpretation that asserts otherwise in view of the present disclosure is unreasonable on its face. Unless expressly stated otherwise in a claim granted outside the United States, a claim does not cover a signal per se or mere energy.

Moreover, notwithstanding anything apparently to the contrary elsewhere herein, a clear distinction is to be understood between (a) computer readable storage media and computer readable memory, on the one hand, and (b) transmission media, also referred to as signal media, on the other hand. A transmission medium is a propagating signal or a carrier wave computer readable medium. By contrast, computer readable storage media and computer readable memory are not propagating signal or carrier wave computer readable media. Unless expressly stated otherwise in the claim, "computer readable medium" means a computer readable storage medium, not a propagating signal per se and not mere energy.

An "embodiment" herein is an example. The term "embodiment" is not interchangeable with "the invention". Embodiments may freely share or borrow aspects to create other embodiments (provided the result is operable), even if a resulting combination of aspects is not explicitly described per se herein. Requiring each and every permitted combination to be explicitly and individually described is unnecessary for one of skill in the art, and would be contrary to policies which recognize that patent specifications are written for readers who are skilled in the art. Formal combinatorial calculations and informal common intuition regarding the number of possible combinations arising from even a small number of combinable features will also indicate that a large number of aspect combinations exist for the aspects described herein. Accordingly, requiring an explicit recitation of each and every combination would be contrary to policies calling for patent specifications to be concise and for readers to be knowledgeable in the technical fields concerned.

LIST OF REFERENCE NUMERALS

The following list is provided for convenience and in support of the drawing figures and as part of the text of the specification, which describe innovations by reference to multiple items. Items not listed here may nonetheless be part of a given embodiment. For better legibility of the text, a given reference number is recited near some, but not all, recitations of the referenced item in the text. The same reference number may be used with reference to different examples or different instances of a given item. The list of reference numerals is:

100 operating environment, also referred to as computing environment

102 computer system, also referred to as a "computational system" or "computing system", and when in a network may be referred to as a "node"

104 users, e.g., user of an enhanced system 202

106 peripherals

108 network generally, including, e.g., LANs, WANs, software-defined networks, clouds, and other wired or wireless networks

110 processor

112 computer-readable storage medium device, e.g., RAM, hard disks

114 removable configured computer-readable storage medium

116 instructions executable with processor; may be on removable storage media or in other memory (volatile or nonvolatile or both)

118 data

120 kernel(s), e.g., operating system(s), BIOS, UEFI, device drivers

122 tools, e.g., anti-virus software, firewalls, packet sniffer software, intrusion detection systems, intrusion prevention systems, other cybersecurity tools, debuggers, profilers, compilers, interpreters, decompilers, assemblers, disassemblers, source code editors, autocompletion software, simulators, fuzzers, repository access tools, version control tools, optimizers, collaboration tools, other software development tools and tool suites (including, e.g., integrated development environments), hardware development tools and tool suites, diagnostics, and so on

124 applications, e.g., word processors, web browsers, spreadsheets, games, email tools, commands

126 display; also referred to as "display device"

128 computing hardware not otherwise associated with a reference number 106, 108, 110, 112, 114, e.g., batteries

202 system 102 enhanced with adaptive recoloring functionality, e.g., functionality to perform any operation or operational sequence noted in any of the Figures and first described herein

204 program equipped with adaptive recoloring functionality, e.g., enhanced editor software 204 or another enhanced tool 122 or application 124 or kernel 120 enhanced with adaptive recoloring software 210

206 user interface which configures at least part of display 126

208 display item, e.g., word, selection, sentence, paragraph, logo, or other item which can be recolored

210 adaptive recoloring software, e.g., software which upon execution performs any method shown in FIG. 8 or FIG. 9

212 adaptive recoloring generally

214 digital content, e.g., displayable content of a word processor document, spreadsheet document, source code document, or other document in a digital (computer-readable and software-editable) format; may include text, graphics, etc.

216 color; also referred to as a particular color name such as "red" or "white", or as "color value"; digital

218 color palette; a set of colors 216; digital data structure

220 recoloring constraint; implemented in software

222 recoloring goal; implemented in software

224 coloring role; may be explicit or implicit in software or in a displayed image

226 focus area of display 126, e.g., area nearby a text insertion point

228 area of display 126 other than the focus area

230 mapping from one color palette to another, or from one color space to another; implemented in software; numeral 230 and "mapping" refer to noun or verb, as indicated by context

302 preliminary color palette, namely, a color palette prior to a recoloring of interest (one recoloring's optimized palette may be another recoloring's preliminary palette); digital data structure

304 optimized color palette, namely, a color palette after at least part of a recoloring of interest; digital data structure

306 command from user; command is input through user interface

308 color difference, e.g., as calculated with a metric 310

310 color metric, also referred to as "metric", "metric function", or "color space metric"; implemented in software or hardware or both

312 location in a display, e.g., pixel coordinates, or identity of an enclosing display unit

314 color space; implemented in software or hardware or both

316 active rule 342, namely, a rule currently in force and not overridden by a user command; numeral 316 may also refer to activation of a rule, depending on context

318 inactive or deactivated rule 342, namely, a rule not currently in force; numeral 318 may also refer to deactivation of a rule, depending on context

320 branding, e.g., a branding palette of colors used for branding, or rules 342 which support branding; branding concerns commercial identity of an entity that provides goods or services or both

322 replaced color 216

324 replacement color 216

326 spacing between color sets, e.g., between averages or centroids, as measured by a metric

328 color set, e.g., a set of colors that do not necessarily all belong to a given palette

330 pixel; digital data structure whose value indicates a color and in some cases also indicates a transparency; voxels are considered pixels for present purposes

332 user action as detected by a user interface

334 display brightness, e.g., brightness setting or output of a screen

336 ambient brightness, e.g., brightness level of physical environment around a screen

338 highlighting action performed via a user interface

340 source code syntax

342 recoloring rule, e.g., constraint 220 or goal 222; implemented in software or hardware or both

402 isometry mapping 230

404 tolerance isometry mapping 230

408 dichromatic color space 314

410 protanopic color space 314
412 deuteranopic color space 314
414 tritanopic color space 314
416 monochromatic color space 314
418 tolerance, e.g., in absolute terms or as a percentage or other ratio
420 color space 314 designed with particular attention to autism, attention deficit disorders, cognitive learning challenge(s), or diagnosed condition(s) characterized at least in part by an emotional response to one or more colors
422 autism
424 attention deficit disorders (with or without hyperactivity)
426 cognitive learning challenge
428 user interface mechanism for color selection
502 screen; an example of a display 126 which uses light emitting diodes, liquid crystals, plasma, electron guns, or another technology that paints pixels or line vectors directly in or on a surface; used herein in contrast to projectors that transmit colored light through air to create an image even though that image may be informally called a "screen"
504 physical distance between locations on a screen
506 projector that transmits colored light through air to create an image; an example of a display 126
508 two-dimensional image; image on a surface in the mathematical sense—not necessarily flat since it could appear on a curved surface
510 three-dimensional image; image which has volume in the mathematical sense; also includes so-called "two and a half" dimensional images
600 image; an ordered set of pixels (may be implemented as vectors)
602 document; digital structure containing content 214, which typically also has a name and a storage location, e.g., in a file system
604 text in a natural language; digital
606 text in a computer programming language; digital
608 zooming action in a user interface; includes zooming in or zooming out, or panning a zoom effect to a different screen location; "zoom" may also refer to a result of zooming
610 computer programming language source code; e.g., in a language that can be processed by a compiler or interpreter
612 natural language, e.g., Arabic, Chinese, English, French, German, Greek, Hebrew, Japanese, Klingon, Korean, Latin, Russian, Spanish, or another spoken or written language not specifically designed to be processed by a compiler or interpreter
614 mathematical expression, e.g., an equation, formula, or expression containing mathematical notation
616 line drawing in an image
618 line in an image
620 logo or trademark in an image
622 photograph derivative; digital
624 digital photograph
702 foreground coloring role; also referred to as "foreground"; may refer to the role per se or to a particular color which is employed in the role
704 background coloring role; also referred to as "background"; may refer to the role per se or to a particular color which is employed in the role
706 dormant coloring role; also referred to as "greytext"; may refer to the role per se or to a particular color which is employed in the role
708 adornment coloring role; also referred to as "adornment"; may refer to the role per se or to a particular color which is employed in the role; adornments include visual additions to source code
710 selection-based highlighting coloring role; also referred to as "selection-based highlighting", or as "highlighting" when selection of a display item by a user is the context; may refer to the role per se or to a particular color which is employed in the role
712 partial underlining coloring role; also referred to as "partial underlining" or "partial underline"; may refer to the role per se or to a particular color which is employed in the role; like underlining 714 but may be applied to only part of a display unit, may be dashed, or both, in some embodiments
714 underlining coloring role; also referred to as "underlining" or "underline"; may refer to the role per se or to a particular color which is employed in the role
716 syntax-based highlighting coloring role; also referred to as "syntax-based highlighting", or as "highlighting" when proactive syntactic parsing of displayed items by a tool is the context; may refer to the role per se or to a particular color which is employed in the role
718 outline coloring role; also referred to as "outline"; refers to a font or characters or graphics as opposed to a nested organization of topics; may refer to the role per se or to a particular color which is employed in the role
720 warning coloring role; also referred to as "warning" or "warnings"; may refer to the role per se or to a particular color which is employed in the role
722 error coloring role; also referred to as "error" or "errors"; may refer to the role per se or to a particular color which is employed in the role; error 722 and warning 720 may be lumped together in some embodiments
724 other coloring roles related to a feature of a tool, a language, or a content, for example; may refer to the role per se or to a particular color which is employed in the role
800 flowchart; 800 also refers to adaptive recoloring methods illustrated by or consistent with the FIG. 8 flowchart
802 computationally identify an active color palette constraint 220, e.g., by checking a list, table, array, tree, or other data structure which represents constraints in software 210
804 computationally ascertain an active color palette goal 222, e.g., by checking a list, table, array, tree, or other data structure which represents goals in software 210
806 computationally determine an optimized palette 304, e.g., through hill climbing or another optimization heuristic or algorithm, in view of the active color palette constraint(s) 220 and the active color palette goal(s) 222, from a preliminary palette 302
808 computationally confirm or enforce compliance of a candidate optimized palette 304 with the active color palette constraint(s) 220, e.g., by adjusting candidate colors or by rejecting the candidate
810 computationally confirm or enforce pursuit of a candidate optimized palette 304 that meets the active color palette goal(s) 222, e.g., by adjusting candidate colors or by rejecting the candidate
812 computationally configure a display, e.g., by loading data into a frame buffer of the display
814 use an optimized palette, e.g., by displaying only colors that belong to the optimized palette

900 flowchart; 900 also refers to adaptive recoloring methods illustrated by or consistent with the FIG. 9 flowchart (which incorporates the steps of FIG. 8)

902 computationally change a difference between two colors, by changing one or both of those colors

904 computationally maintain a difference between two colors under a given metric 310, either by changing neither of those colors, or by changing them both without also changing the distance between them under the given metric

906 computationally provide a color difference gradient

908 a color difference gradient; a property of colors at a sequence or set of locations nearby one another in which the colors change in a progression

910 computationally increase a color difference 308

912 computationally decrease a color difference 308

914 computationally enforce a bound (limit) on color difference 308

916 computationally enforce a bound (limit) on color spacing 326 difference 308

918 computationally obtain a perception compensation mapping 230, e.g., by reading a mapping data structure from storage 112 or by reading code that implements a mapping 230

920 computationally perform a perception compensation mapping, e.g., to replace palette colors according to a mapping 230

922 computationally detect a text size change, e.g., a change in physical size of a given character on screen

924 computationally detect a screen size change, e.g., from a device with an N1 by M1 screen (pixels, inches, centimeters, etc.) to a device with an N2 by M2 screen, with N1!=N2 or M1!=M2 or both; may also refer to a change in the size of the window allocated to the display of content 214

926 computationally heighten a color transition, e.g., at one edge of a display unit

928 color transition; an example of a color difference; color transition generally refers to a difference in colors at nearby locations, especially for adjacent display items; a location X is deemed "nearby" a location Y if the straight line screen distance between X and Y is less than any of the following: twenty pixels, 10% of the screen height, 10% of the screen width, or ten text characters

930 computationally deactivate a recoloring rule 342, e.g., by removing the rule from a data structure of active rules, or by marking a bit or other variable in the rule to indicate the rule is inactive

932 computationally activate a recoloring rule 342, e.g., by adding the rule to a data structure of active rules, or by marking a bit or other variable in the rule to indicate the rule is active

934 computationally modify a recoloring rule 342, e.g., by changing a tolerance 418, minimum difference 308, maximum difference 308, coloring role 224, particular color 216, mapping 230, focus area 226 definition, color space 314, or other aspect of the rule

936 computationally recognize a user action, e.g., by employing a user interface API, callback, or other software mechanism

938 computationally distinguish a focus area from another area by recoloring

940 computationally warn a user, e.g., by displaying text of a warning

942 user request, e.g., user action, user command, or an interaction with the user interface that is not necessarily specific to recoloring

944 computationally detect a brightness change (screen or ambient)

946 computationally select a color 216; in the context of making room for a new color assignment, the selected color is generally close to the color it replaces

948 computationally replace a color 216

950 computationally optimize a palette or a set of one or more colors

952 computationally receive a command, e.g., via a user interface

954 computationally alter a color; also refers to result of alteration

956 computationally and interactively tune a color; presumes direct user control of color selection via a user interface tuning mechanism

958 any step discussed in the present disclosure that has not been assigned some other reference numeral

CONCLUSION

In short, the teachings herein provide a variety of adaptive recoloring functionalities which operate in enhanced systems 202. Adaptive recoloring 212 of displayed digital content 214 automatically pursues 810 specified active color palette goals 222 while adhering 808 to specified active color palette constraints 220. Source code editors 204, word processors 204, and other programs 204 are enhanced by software 210 tailored for adaptive recoloring 212. Recoloring rules 342 may specify coloring roles 224, colors 216, tolerances 418, color spaces 314, color difference 308 metrics 310, and other criteria. Recoloring 212 may be triggered by a zoom 608 or another change in user focus 226, by a change in ambient brightness 336 or in screen brightness 334, by a screen size change 924, by notice 230 of a user perception change, or by another event. Recoloring 212 improves text legibility, assists user focus, compensates 230 for differences in color perception and emotional impact, and increases color 216 availability without degrading usability, for example. Transitions 928 between words or other display items 208 can be heightened 926. Branding 320 colors 216 may be preserved, in logos 620 and text 604. Automatic recoloring selections 304 may be overridden 306 by a user command or by interactive tuning 956, with warnings given 940 as appropriate.

Embodiments are understood to also themselves include or benefit from tested and appropriate security controls and privacy controls such as the General Data Protection Regulation (GDPR), e.g., it is understood that appropriate measures should be taken to help prevent misuse of computing systems through the injection or activation of malware into user software. Use of the tools and techniques taught herein is compatible with use of such controls.

Although Microsoft technology is used in some motivating examples, the teachings herein are not limited to use in technology supplied or administered by Microsoft. Under a suitable license, for example, the present teachings could be embodied in software or services provided by other cloud service providers.

Although particular embodiments are expressly illustrated and described herein as processes, as configured storage media, or as systems, it will be appreciated that discussion of one type of embodiment also generally extends to other embodiment types. For instance, the descriptions of processes in connection with FIGS. 8 and 9 also help describe configured storage media, and help describe the technical effects and operation of systems and manufactures like those discussed in connection with other Figures. It does not follow that limitations from one embodiment are necessarily read into another. In particular, processes are not necessarily limited to the data structures and arrangements presented while discussing systems or manufactures such as configured memories.

Those of skill will understand that implementation details may pertain to specific code, such as specific thresholds, comparisons, specific kinds of runtimes or programming languages or architectures, specific scripts or other tasks, and specific computing environments, and thus need not appear in every embodiment. Those of skill will also understand that program identifiers and some other terminology used in discussing details are implementation-specific and thus need not pertain to every embodiment. Nonetheless, although they are not necessarily required to be present here, such details may help some readers by providing context and/or may illustrate a few of the many possible implementations of the technology discussed herein.

With due attention to the items provided herein, including technical processes, technical effects, technical mechanisms, and technical details which are illustrative but not comprehensive of all claimed or claimable embodiments, one of skill will understand that the present disclosure and the embodiments described herein are not directed to subject matter outside the technical arts, or to any idea of itself such as a principal or original cause or motive, or to a mere result per se, or to a mental process or mental steps, or to a business method or prevalent economic practice, or to a mere method of organizing human activities, or to a law of nature per se, or to a naturally occurring thing or process, or to a living thing or part of a living thing, or to a mathematical formula per se, or to isolated software per se, or to a merely conventional computer, or to anything wholly imperceptible or any abstract idea per se, or to insignificant post-solution activities, or to any method implemented entirely on an unspecified apparatus, or to any method that fails to produce results that are useful and concrete, or to any preemption of all fields of usage, or to any other subject matter which is ineligible for patent protection under the laws of the jurisdiction in which such protection is sought or is being licensed or enforced.

Reference herein to an embodiment having some feature X and reference elsewhere herein to an embodiment having some feature Y does not exclude from this disclosure embodiments which have both feature X and feature Y, unless such exclusion is expressly stated herein. All possible negative claim limitations are within the scope of this disclosure, in the sense that any feature which is stated to be part of an embodiment may also be expressly removed from inclusion in another embodiment, even if that specific exclusion is not given in any example herein. The term "embodiment" is merely used herein as a more convenient form of "process, system, article of manufacture, configured computer readable storage medium, and/or other example of the teachings herein as applied in a manner consistent with applicable law." Accordingly, a given "embodiment" may include any combination of features disclosed herein, provided the embodiment is consistent with at least one claim.

Not every item shown in the Figures need be present in every embodiment. Conversely, an embodiment may contain item(s) not shown expressly in the Figures. Although some possibilities are illustrated here in text and drawings by specific examples, embodiments may depart from these examples. For instance, specific technical effects or technical features of an example may be omitted, renamed, grouped differently, repeated, instantiated in hardware and/or software differently, or be a mix of effects or features appearing in two or more of the examples. Functionality shown at one location may also be provided at a different location in some embodiments; one of skill recognizes that functionality modules can be defined in various ways in a given implementation without necessarily omitting desired technical effects from the collection of interacting modules viewed as a whole. Distinct steps may be shown together in a single box in the Figures, due to space limitations or for convenience, but nonetheless be separately performable, e.g., one may be performed without the other in a given performance of a method.

Reference has been made to the figures throughout by reference numerals. Any apparent inconsistencies in the phrasing associated with a given reference numeral, in the figures or in the text, should be understood as simply broadening the scope of what is referenced by that numeral. Different instances of a given reference numeral may refer to different embodiments, even though the same reference numeral is used. Similarly, a given reference numeral may be used to refer to a verb, a noun, and/or to corresponding instances of each, e.g., a processor 110 may process 110 instructions by executing them.

As used herein, terms such as "a", "an", and "the" are inclusive of one or more of the indicated item or step. In particular, in the claims a reference to an item generally means at least one such item is present and a reference to a step means at least one instance of the step is performed. Similarly, "is" and other singular verb forms should be understood to encompass the possibility of "are" and other plural forms, when context permits, to avoid grammatical errors or misunderstandings.

Headings are for convenience only, information on a given topic may be found outside the section whose heading indicates that topic.

All claims and the abstract, as filed, are part of the specification.

To the extent any term used herein implicates or otherwise refers to an industry standard, and to the extent that applicable law requires identification of a particular version of such as standard, this disclosure shall be understood to refer to the most recent version of that standard which has been published in at least draft form (final form takes precedence if more recent) as of the earliest priority date of the present disclosure under applicable patent law.

While exemplary embodiments have been shown in the drawings and described above, it will be apparent to those of ordinary skill in the art that numerous modifications can be made without departing from the principles and concepts set forth in the claims, and that such modifications need not encompass an entire abstract concept. Although the subject matter is described in language specific to structural features and/or procedural acts, it is to be understood that the subject matter defined in the appended claims is not necessarily limited to the specific technical features or acts described above the claims. It is not necessary for every means or aspect or technical effect identified in a given definition or example to be present or to be utilized in every embodiment. Rather, the specific features and acts and effects described are disclosed as examples for consideration when implementing the claims.

All changes which fall short of enveloping an entire abstract idea but come within the meaning and range of equivalency of the claims are to be embraced within their scope to the full extent permitted by law.

What is claimed is:

1. A computing system equipped for adaptive recoloring, the computing system comprising:

a display having an associated preliminary color palette;

a digital memory; and a processor in operable communication with the digital memory and the display, the processor configured to perform adaptive recoloring steps which include (a) identifying one or more active color palette constraints, (b) ascertaining one or more active color palette goals, (c) determining an optimized color palette, through an optimization algorithm, in view of at least one active color palette constraint and at least one active color palette goal, wherein the determined optimized color palette is closer to at least one active color palette goal than the preliminary color palette is to the active color palette goal and wherein the optimized color palette is compliant with all active color palette constraints, the active color palette goal is pursued at least in part by adjusting at least one candidate color or by rejecting at least one candidate color, or both, and (d) configuring at least a portion of the display to use the optimized color palette in place of the preliminary color palette.

2. The system of claim 1, wherein each color palette defines at least two coloring roles, and the at least one active color palette goal specifies at least one of the following:

changing a color difference between a first coloring role and a second coloring role;

changing a first display item color difference between a first coloring role and a second coloring role in a first display item while maintaining a second display item color difference between the first coloring role and the second coloring role in a second display item; or changing a color difference between a first display item color in a coloring role in a first display item and a second display item color in the coloring role in a second display item.

3. The system of claim 1, wherein the display includes a focus area and a non-focus area, and the at least one active color palette goal specifies at least one of the following:

increasing a color difference between a first display item in the focus area and a second display item in the non-focus area;

providing a color difference gradient between a first display item in the focus area and a second display item in the non-focus area; or increasing a color difference between a first display item which is in the focus area and which has a first coloring role and a second display item which also has the first coloring role but is in the non-focus area.

4. The system of claim 1, wherein the at least one active color palette constraint specifies at least one of the following:

limiting a color difference between a replaced color of the preliminary color palette and replacement color which replaces the replaced color in the optimized color palette;

limiting a color difference between a replaced color of the preliminary color palette which at least partially fills a coloring role, and a replacement color which replaces the replaced color in the optimized color palette and also at least partially fills the coloring role; or limiting a color spacing difference between a set of replaced colors of the preliminary color palette and a set of replacement colors which replaces the set of replaced colors in the optimized color palette.

5. The system of claim 1, further comprising a perception compensation mapping which specifies at least one of the following:

an isometry between the preliminary color palette and the optimized color palette;

a tolerance isometry between the preliminary color palette and the optimized color palette;

a mapping which transforms color differences in a trichromatic space to color differences in a fully dichromatic space;

a mapping which transforms color differences in a trichromatic space to color differences in a protanopic space;

a mapping which transforms color differences in a trichromatic space to color differences in a deuteranopic space;

a mapping which transforms color differences in a trichromatic space to color differences in a tritanopic space;

a mapping which transforms color differences in a trichromatic space to color differences in a monochromatic space; or a mapping which transforms color differences in a trichromatic space to color differences in a space optimized for viewers with autism, an attention deficit disorder, a cognitive learning challenge, or a diagnosed condition characterized at least in part by an emotional response to one or more colors.

6. A method for adaptively recoloring a display, the method comprising automatically and proactively:

identifying one or more active color palette constraints;

ascertaining one or more active color palette goals;

determining an optimized color palette, through an optimization algorithm, in view of at least one active color palette constraint and at least one active color palette goal, wherein the determined optimized color palette is closer to at least one active color palette goal than a preliminary color palette is to the active color palette goal and wherein the optimized color palette is compliant with all active color palette constraints, and the active color palette goal is pursued at least in part by adjusting at least one candidate color or by rejecting at least one candidate color, or both; and configuring at least a portion of a display to use the optimized color palette in place of the preliminary color palette.

7. The method of claim 6, wherein determining an optimized color palette comprises at least one of the following:

increasing a difference between coloring roles in response to detecting a decrease in a physical dimension of a displayed text;

decreasing a difference between coloring roles in response to detecting an increase in a physical dimension of a displayed text;

increasing a difference between coloring roles in response to detecting use of a screen which has a physical dimension below a specified threshold; or decreasing a difference between coloring roles in response to detecting use of a screen which has a physical dimension above a specified threshold.

8. The method of claim 6, wherein determining an optimized color palette comprises:

recognizing a user action which indicates a focus area of the display; and distinguishing the focus area from a non-focus area in at least one of the following ways: applying an area-specific color palette constraint, or pursuing an area-specific color palette goal.

9. The method of claim 6, further comprising at least one of the following:

deactivating an active color palette constraint in response to a user action;

deactivating an active color palette goal in response to a user action;

modifying an active color palette constraint in response to a user action;

modifying an active color palette goal in response to a user action;

in response to a user action requesting a change to a color, warning the user that changing the color as requested will violate an active color palette constraint; or in response to a user action requesting a change to a color, warning the user that changing the color as requested will hinder pursuit of an active color palette goal.

10. The method of claim 6, wherein determining an optimized color palette comprises at least one of the following:

increasing a difference between coloring roles only within a focus area of the display; or decreasing a difference between coloring roles only within a non-focus area of the display.

11. The method of claim 6, wherein determining an optimized color palette comprises heightening a color transition between a pair of adjacent words, the pair including a first word and a second word, such that a color difference between a first pixel at a first location in the first word and a second pixel at a second location in the second word increases as a screen distance between the first location and the second location reduces.

12. The method of claim 6, wherein determining an optimized color palette comprises at least one of the following:

increasing a difference between coloring roles in response to detecting a decrease in a display brightness;

decreasing a difference between coloring roles in response to detecting an increase in a display brightness;

increasing a difference between coloring roles in response to detecting an increase in an ambient brightness; or decreasing a difference between coloring roles in response to detecting a decrease in an ambient brightness.

13. The method of claim 6, wherein determining an optimized color palette comprises:

selecting a color which is not in the preliminary color palette but is closer to a preliminary palette color than is permitted by an active color palette distance constraint; and replacing the preliminary palette color with a replacement color that satisfies the active color palette distance constraint;

wherein the optimized color palette includes the selected color, and all colors in the optimized palette satisfy the active color palette distance constraint.

14. The method of claim 6, further comprising performing syntax highlighting, wherein the syntax highlighting employs two or more colors of the optimized color palette, and wherein the syntax highlighting employs at least one color that is in the optimized color palette and not in the preliminary color palette.

15. The method of claim 6, wherein determining an optimized color palette comprises:

displaying at least two colors;

receiving a color alteration command through a user interface;

altering at least one color based on the color alteration command; and updating the display to reflect the color altering;

wherein the optimized color palette is specified at least in part by interactive color tuning.

16. A computer-readable storage device configured with data and instructions which upon execution by a processor cause a computing system to perform a method for adaptively recoloring a display, the method comprising automatically:

identifying one or more active color palette constraints;

ascertaining one or more active color palette goals;

determining an optimized color palette, through an optimization algorithm, in view of at least one active color palette constraint and at least one active color palette goal, wherein the determined optimized color palette is closer to at least one active color palette goal than a preliminary color palette is to the active color palette goal and wherein the optimized color palette is compliant with all active color palette constraints, and the active color palette goal is pursued at least in part by adjusting at least one candidate color or by rejecting at least one candidate color, or both; and configuring at least a portion of a display to use the optimized color palette in place of the preliminary color palette.

17. The storage device of claim 16, in combination with the display, and wherein the display includes at least one of the following:

a screen;

a projector;

a device configured to show a two-dimensional image; or a device configured to show a three-dimensional image.

18. The storage device of claim 16, wherein configuring the display includes displaying at least one of the following in an image that includes at least two colors of the optimized color palette:

a source code text;

a natural language text;

a mathematical expression;

a line drawing;

a logo; or a photograph derivative.

19. The storage device of claim 16, wherein determining an optimized color palette comprises:

recognizing a user zooming action which indicates a focus area of the display; and increasing a color difference between a first display item in the focus area and a second display item in a non-focus area.

20. The storage device of claim 16, wherein each color palette defines at least two of the following coloring roles:

a foreground role;

a background role;

a selection-based highlighting role;

a syntax-based highlighting role;

a dormant role;

an adornment role;

an underline role;

a partial underline role;

an outline role;

a warning role; or an error role.

* * * * *